US010071558B2

(12) United States Patent
Sasaki et al.

(10) Patent No.: US 10,071,558 B2
(45) Date of Patent: Sep. 11, 2018

(54) SYSTEM, CONTROL METHOD THEREFOR, PRINTING APPARATUS, AND CONTROL METHOD THEREFOR

(71) Applicant: CANON KABUSHIKI KAISHA, Tokyo (JP)

(72) Inventors: Takeru Sasaki, Kawasaki (JP); Yusuke Hashii, Tokyo (JP); Akitoshi Yamada, Yokohama (JP); Kentaro Yano, Yokohama (JP); Takayuki Aizawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/471,014

(22) Filed: Mar. 28, 2017

(65) Prior Publication Data

US 2017/0282586 A1 Oct. 5, 2017

(30) Foreign Application Priority Data

Apr. 5, 2016 (JP) ..... 2016-076117

(51) Int. Cl.
*B41J 2/175* (2006.01)

(52) U.S. Cl.
CPC ..... *B41J 2/17543* (2013.01); *B41J 2/175* (2013.01); *B41J 2/17566* (2013.01); *B41J 2/17503* (2013.01); *B41J 2/17533* (2013.01)

(58) Field of Classification Search
CPC .... B41J 2/17543; B41J 2/17566; B41J 2/175; B41J 2/17503; B41J 2/17533
See application file for complete search history.

(56) References Cited

U.S. PATENT DOCUMENTS 6,142,600 A 11/2000 Takahashi et al.
6,788,434 B1 9/2004 Kanematsu et al.
(Continued)

FOREIGN PATENT DOCUMENTS

CN 103507445 A 1/2014
CN 203974237 U 12/2014
(Continued)

OTHER PUBLICATIONS

European Search Report dated Aug. 1, 2017, in European Patent Application No. 17000486.5.
(Continued)

*Primary Examiner* — Yaovi M Ameh
(74) *Attorney, Agent, or Firm* — Fitzpatrick, Cella, Harper & Scinto

(57) ABSTRACT

A system comprises: an obtaining unit that obtains predetermined information relating to amount of printing materials for a tank attached to a printing apparatus; and a determining unit that determines an interchangeable tank to be provided from a plurality of types of interchangeable tanks based on the predetermined information, wherein the plurality of types of interchangeable tanks include a first tank and a second tank, the first tank contains printing materials of at least two colors, with a ratio of amounts of the printing materials of the at least two colors being a first constituent ratio, and the second tank contains printing materials of at least the same two colors as those in the first tank, with a ratio of amounts of the printing materials of at least the two colors being a second constituent ratio different from the first constituent ratio.

18 Claims, 26 Drawing Sheets

(56) References Cited

U.S. PATENT DOCUMENTS

| | | | | |
|---|---|---|---|---|
| 7,382,475 | B2 | 6/2008 | Aizawa | |
| 7,430,054 | B2 | 9/2008 | Masumoto et al. | |
| 7,719,706 | B2 | 5/2010 | Suga et al. | |
| 8,179,546 | B2 | 5/2012 | Aichi et al. | |
| 8,274,675 | B2 | 9/2012 | Suga et al. | |
| 8,654,382 | B2 | 2/2014 | Suga et al. | |
| 8,934,134 | B2 | 1/2015 | Ono et al. | |
| 8,976,411 | B2 | 3/2015 | Yamada et al. | |
| 9,013,750 | B2 | 4/2015 | Yamada et al. | |
| 9,073,726 | B2 | 7/2015 | Kanamoto | |
| 9,203,987 | B2 | 12/2015 | Suga et al. | |
| 9,466,017 | B2 | 10/2016 | Yamada et al. | |
| 9,658,812 | B2 | 5/2017 | Kanamoto | |
| 2004/0223185 | A1 | 11/2004 | Yamada et al. | |
| 2011/0001992 | A1 | 1/2011 | Kajihara et al. | |
| 2011/0012953 | A1* | 1/2011 | Nakamura | B41J 2/17513 347/19 |
| 2015/0165777 | A1* | 6/2015 | Mizutani | B41J 2/1752 347/85 |
| 2016/0275380 | A1 | 9/2016 | Hashi et al. | |
| 2016/0381247 | A1 | 12/2016 | Yamada et al. | |
| 2017/0034396 | A1 | 2/2017 | Kajihara et al. | |

FOREIGN PATENT DOCUMENTS

| | | | |
|---|---|---|---|
| CN | 205097706 | U | 3/2016 |
| JP | 2001-228761 | A | 8/2001 |

OTHER PUBLICATIONS

Office Action dated May 25, 2018, issued in Chinese Patent Application No. 201710187866.1.

* cited by examiner

FIG. 9

| | | ADDITIONAL TANK (DETERMINATION RESULT) | | |
|---|---|---|---|---|
| | TANK TYPE IN USE (Tank_Type) | Red_Rich | Std | Bk_Rich |
| REMAINING AMOUNT OF Red INK (Rem_Red) | REMAINING AMOUNT OF Bk INK (Rem_Bk) | | | |
| 0 | 0 | Red_Rich | Std | Bk_Rich |
| 0 | 1 | Red_Rich | Std | Std |
| 0 | 2 | Red_Rich | Red_Rich | Red_Rich |
| 1 | 0 | Std | Std | Bk_Rich |
| 1 | 1 | – | – | – |
| 1 | 2 | – | – | – |
| 2 | 0 | Bk_Rich | Bk_Rich | Bk_Rich |
| 2 | 1 | – | – | – |
| 2 | 2 | – | – | – |

FIG. 10

| | | | ADDITIONAL TANK (DETERMINATION RESULT) |
|---|---|---|---|
| PREVIOUS | CURRENT | NEXT (CANDIDATE) | |
| Red_Rich | Red_Rich | Red_Rich | Red_Rich |
| Red_Rich | Red_Rich | Std | Red_Rich |
| Red_Rich | Red_Rich | Bk_Rich | Std |
| Red_Rich | Std | Red_Rich | Red_Rich |
| Red_Rich | Std | Std | Std |
| Red_Rich | Std | Bk_Rich | Std |
| Red_Rich | Bk_Rich | Red_Rich | Std |
| Red_Rich | Bk_Rich | Std | Std |
| Red_Rich | Bk_Rich | Bk_Rich | Std |
| Std | Red_Rich | Red_Rich | Red_Rich |
| Std | Red_Rich | Std | Red_Rich |
| Std | Red_Rich | Bk_Rich | Std |
| Std | Std | Red_Rich | Std |
| Std | Std | Std | Std |
| Std | Std | Bk_Rich | Std |
| Std | Bk_Rich | Red_Rich | Std |
| Std | Bk_Rich | Std | Std |
| Std | Bk_Rich | Bk_Rich | Bk_Rich |
| Bk_Rich | Red_Rich | Red_Rich | Std |
| Bk_Rich | Red_Rich | Std | Std |
| Bk_Rich | Red_Rich | Bk_Rich | Std |
| Bk_Rich | Std | Red_Rich | Std |
| Bk_Rich | Std | Std | Std |
| Bk_Rich | Std | Bk_Rich | Bk_Rich |
| Bk_Rich | Bk_Rich | Red_Rich | Std |
| Bk_Rich | Bk_Rich | Std | Bk_Rich |
| Bk_Rich | Bk_Rich | Bk_Rich | Bk_Rich |

FIG. 12

| | | | INTERCHANGEABLE TANK (DETERMINATION RESULT) | | | |
|---|---|---|---|---|---|---|
| | | TANK TYPE IN USE | Std | C_Rich | M_Rich | Y_Rich |
| REMAINING AMOUNT OF C INK Rem_C | REMAINING AMOUNT OF M INK Rem_M | REMAINING AMOUNT OF Y INK Rem_Y | | | | |
| 0 | 0 | 0 | Std | C_Rich | M_Rich | Y_Rich |
| 0 | 0 | 1 | Std | C_Rich | M_Rich | Std |
| 0 | 0 | 2 | Std | C_Rich | M_Rich | Std |
| 0 | 1 | 0 | Std | C_Rich | Std | Y_Rich |
| 0 | 1 | 1 | Std | C_Rich | Std | Std |
| 0 | 1 | 2 | Std | C_Rich | Std | Std |
| 0 | 2 | 0 | Std | C_Rich | Std | Y_Rich |
| 0 | 2 | 1 | Std | C_Rich | Std | Std |
| 0 | 2 | 2 | C_Rich | C_Rich | C_Rich | C_Rich |
| 1 | 0 | 0 | Std | Std | M_Rich | Y_Rich |
| 1 | 0 | 1 | Std | Std | M_Rich | Std |
| 1 | 0 | 2 | Std | Std | M_Rich | Std |
| 1 | 1 | 0 | Std | Std | Std | Y_Rich |
| 1 | 1 | 1 | – | – | – | – |
| 1 | 1 | 2 | – | – | – | – |
| 1 | 2 | 0 | Std | Std | Std | Y_Rich |
| 1 | 2 | 1 | – | – | – | – |
| 1 | 2 | 2 | – | – | – | – |
| 2 | 0 | 0 | Std | Std | M_Rich | Y_Rich |
| 2 | 0 | 1 | Std | Std | M_Rich | Std |
| 2 | 0 | 2 | M_Rich | M_Rich | M_Rich | M_Rich |
| 2 | 1 | 0 | Std | Std | Std | Y_Rich |
| 2 | 1 | 1 | – | – | – | – |
| 2 | 1 | 2 | – | – | – | – |
| 2 | 2 | 0 | Y_Rich | Y_Rich | Y_Rich | Y_Rich |
| 2 | 2 | 1 | – | – | – | – |
| 2 | 2 | 2 | – | – | – | – |

FIG. 16

| | | ADDITIONAL TANK (DETERMINATION RESULT) | | |
|---|---|---|---|---|
| | TANK TYPE IN USE | Col_Rich | Std | Bk_Rich |
| REMAINING AMOUNT OF Col INK Rem_Col | REMAINING AMOUNT OF Bk INK Rem_Bk | | | |
| 0 | 0 | Col_Rich | Std | Bk_Rich |
| 0 | 1 | Col_Rich | Std | Std |
| 0 | 2 | Col_Rich | Col_Rich | Col_Rich |
| 1 | 0 | Std | Std | Bk_Rich |
| 1 | 1 | – | – | – |
| 1 | 2 | – | – | – |
| 2 | 0 | Bk_Rich | Bk_Rich | Bk_Rich |
| 2 | 1 | – | – | – |
| 2 | 2 | – | – | – |

FIG. 21

| ADDITIONAL L TANK DETERMINATION RESULT | ADDITIONAL R TANK DETERMINATION RESULT | ADDITIONAL TANK NECESSITY COMPREHENSIVE DETERMINATION |
|---|---|---|
| – | - | – |
| – | Red_Rich | Red_Rich |
| – | Std | Std |
| – | Bk_Rich | Bk_Rich |
| Red_Rich | – | Red_Rich |
| Red_Rich | Red_Rich | Red_Rich×2 |
| Red_Rich | Std | Std×2 |
| Red_Rich | Bk_Rich | Std×2 |
| Std | – | Std |
| Std | Red_Rich | Std×2 |
| Std | Std | Std×2 |
| Std | Bk_Rich | Std×2 |
| Bk_Rich | – | Bk_Rich |
| Bk_Rich | Red_Rich | Std×2 |
| Bk_Rich | Std | Std×2 |
| Bk_Rich | Bk_Rich | Bk_Rich×2 |

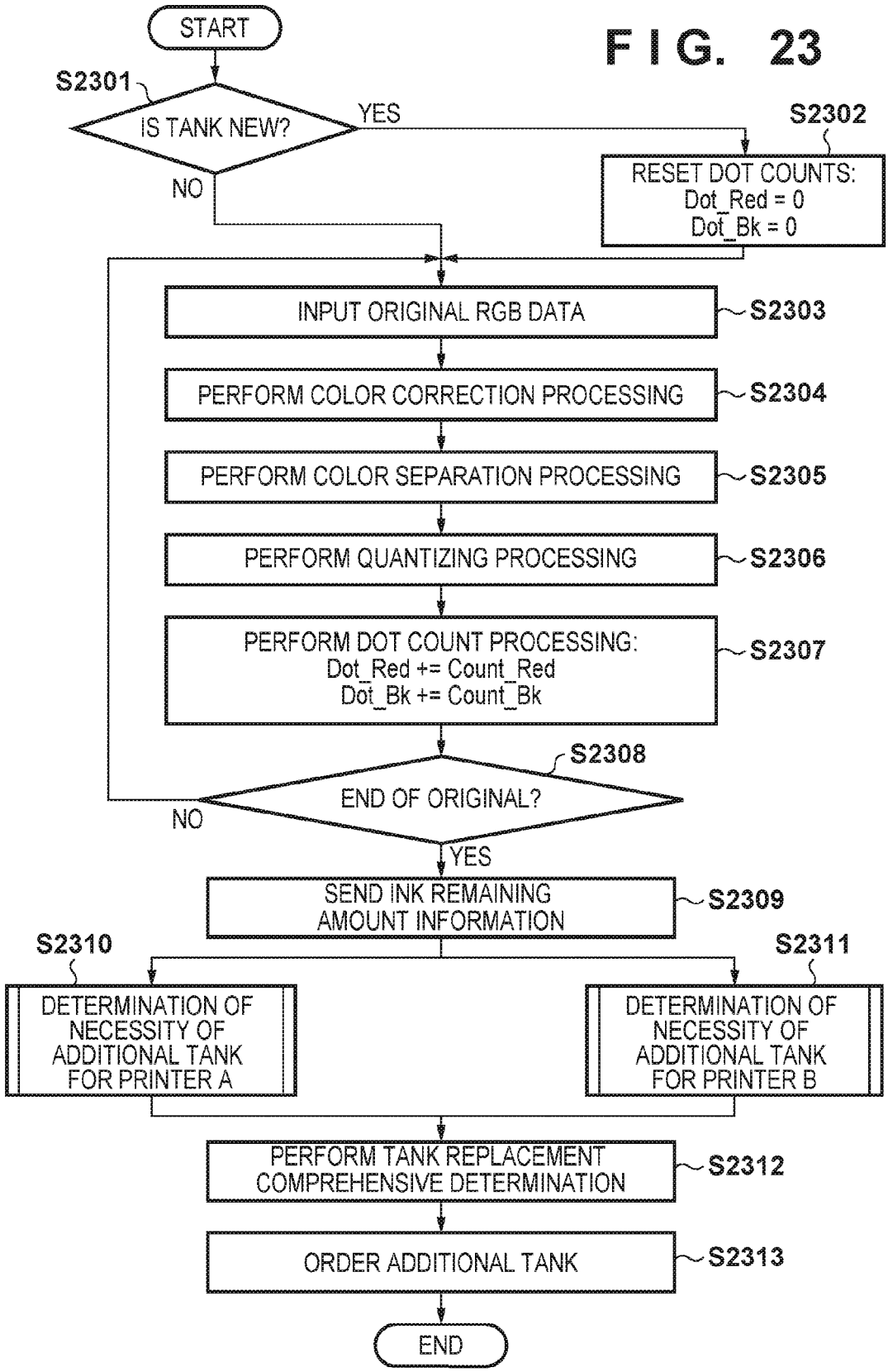
FIG. 23
START
S2301
IS TANK NEW?
YES
NO
S2302
RESET DOT COUNTS:
Dot_Red = 0
Dot_Bk = 0
INPUT ORIGINAL RGB DATA
S2303
PERFORM COLOR CORRECTION PROCESSING
S2304
PERFORM COLOR SEPARATION PROCESSING
S2305
PERFORM QUANTIZING PROCESSING
S2306
PERFORM DOT COUNT PROCESSING:
Dot_Red += Count_Red
Dot_Bk += Count_Bk
S2307
S2308
END OF ORIGINAL?
NO
YES
SEND INK REMAINING AMOUNT INFORMATION
S2309
S2310
S2311
DETERMINATION OF NECESSITY OF ADDITIONAL TANK FOR PRINTER A
DETERMINATION OF NECESSITY OF ADDITIONAL TANK FOR PRINTER B
PERFORM TANK REPLACEMENT COMPREHENSIVE DETERMINATION
S2312
ORDER ADDITIONAL TANK
S2313
END

SYSTEM, CONTROL METHOD THEREFOR, PRINTING APPARATUS, AND CONTROL METHOD THEREFOR

BACKGROUND OF THE INVENTION

Field of the Invention

The present invention relates to a system, a control method therefor, a printing apparatus, and a control method therefor.

Description of the Related Art

When a consumable such as ink or toner has run out or almost run out at the time of use of a printer, the user needs to purchase, by himself/herself, a new interchangeable consumable. In addition, in order to minimize the downtime when needing to replace a consumable, the user needs to purchase an interchangeable consumable in advance and maintain it. In contrast to this, there is a service to automatically deliver the next consumable instead of making the user purchase, by himself/herself, interchangeable consumables and perform cumbersome management of them.

For example, Japanese Patent Laid-Open No. 2001-228761 discloses a technique of predicting the timing of the consumption of toner supplied from a cartridge and delivering a cartridge based on the prediction result.

Colors used frequently for printing vary among the users. That is, colors required in large amounts and colors required in small amounts vary among the users. However, Japanese Patent Laid-Open No. 2001-228761 gives no consideration to colors used by the user for printing.

SUMMARY OF THE INVENTION

In consideration of the above problem, the present invention makes it possible to determine a consumable to be used by the user in consideration of colors used for printing.

According to one aspect of the present invention, there is provided a system which provides an interchangeable tank for a printing apparatus to which at least one tank containing printing materials of at least two colors is attached, comprising: an obtaining unit configured to obtain predetermined information relating to amount of printing materials for a tank attached to the printing apparatus; and a determining unit configured to determine an interchangeable tank to be provided from a plurality of types of interchangeable tanks based on the predetermined information obtained by the obtaining unit, wherein the plurality of types of interchangeable tanks include a first tank and a second tank, the first tank contains printing materials of at least two colors, with a ratio of amounts of the printing materials of the at least two colors being a first constituent ratio, and the second tank contains printing materials of at least the same two colors as those in the first tank, with a ratio of amounts of the printing materials of at least the two colors being a second constituent ratio different from the first constituent ratio.

According to another aspect of the present invention, there is provided a printing apparatus equipped with at least one tank containing printing materials of at least two colors, comprising: an obtaining unit configured to obtain predetermined information relating to amount of printing materials for a tank attached to the printing apparatus; and a determining unit configured to determine an interchangeable tank to be provided from a plurality of types of interchangeable tanks based on the predetermined information obtained by the obtaining unit, wherein the plurality of types of interchangeable tanks include a first tank and a second tank, the first tank contains printing materials of at least two colors, with a ratio of amounts of the printing materials of the at least two colors being a first constituent ratio, and the second tank contains printing materials of at least the same two colors as those in the first tank, with a ratio of amounts of the printing materials of at least the two colors being a second constituent ratio different from the first constituent ratio.

According to another aspect of the present invention, there is provided a method of controlling a system which provides an interchangeable tank for a printing apparatus to which at least one tank containing printing materials of at least two colors is attached, comprising: obtaining predetermined information relating to amount of printing materials for a tank attached to the printing apparatus; and determining an interchangeable tank to be provided from a plurality of types of interchangeable tanks based on the predetermined information obtained in the obtaining, wherein the plurality of types of interchangeable tanks include a first tank and a second tank, the first tank contains printing materials of at least two colors, with a ratio of amounts of the printing materials of the at least two colors being a first constituent ratio, and the second tank contains printing materials of at least the same two colors as those in the first tank, with a ratio of amounts of the printing materials of at least the two colors being a second constituent ratio different from the first constituent ratio.

According to the present invention, it is possible to improve the convenience of a consumable delivery service.

Further features of the present invention will become apparent from the following description of exemplary embodiments (with reference to the attached drawings).

BRIEF DESCRIPTION OF THE DRAWINGS

FIG. 9 is a table for explaining an additional tank determination method according to the first embodiment;

FIG. 10 is a table for explaining the additional tank determination method according to the first embodiment;

FIG. 12 is a table for explaining an additional tank determination method according to the second embodiment;

FIG. 16 is a table for explaining an additional tank determination method according to the third embodiment;

FIG. 21 is a table for explaining an additional tank determination method according to the fourth embodiment;

FIG. 23 is a flowchart for printing processing according to the fifth embodiment.

DESCRIPTION OF THE EMBODIMENTS

Embodiments of the present invention will be described below with reference to the accompanying drawings. Although each embodiment will exemplify an inkjet printer as a printer, this is not exhaustive. The present invention can be applied to any image forming apparatus which uses another type of printing material such as toner.

First Embodiment

[Apparatus Arrangement]

Figure 1:
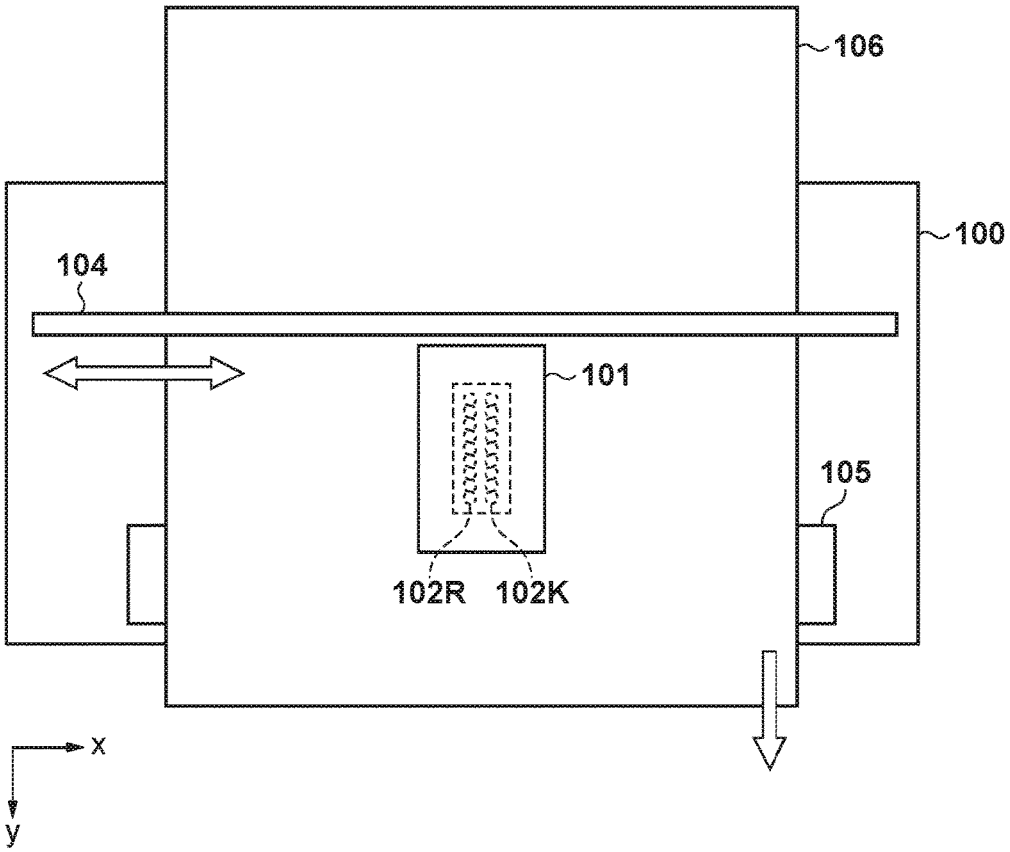
FIG. 1 is a schematic view of a printer according to the first embodiment.

FIG. 1 is a schematic view of a printer according to the first embodiment of the present invention. As shown in FIG. 1, a printer 100 includes a printhead 101 on a frame as a structural member of the printer. The printhead 101 is equipped with a plurality of nozzles for discharging ink, namely red ink nozzles 102R and black ink nozzles 102K. The following will exemplify ink of two colors, namely red and black. However, colors to be used are not limited to these colors or this color combination.

The printer 100 is of a so-called serial printing type, which has nozzles arrayed in a direction (Y direction or sub-scanning direction) perpendicular to the widthwise direction (X direction or main scanning direction) of a printing sheet 106 and prints by scanning the printhead 101 in the X direction along a guide 104. Assume that the nozzle arrangement of a nozzle array of each ink color has a resolution of 1,200 dpi.

The printing sheet 106 as a printing medium is conveyed in the Y direction as a convey roller 105 (and other rollers (not shown)) is rotated by the driving force of a motor (not shown). After the printing sheet 106 is fed, a plurality (a predetermined number) of nozzles of the printhead 101 discharge ink in accordance with print data, thereby printing an image corresponding to one scan width corresponding to each nozzle array of the printhead 101. After printing, the printing sheet 106 is conveyed in the Y direction by a width corresponding to each nozzle array, and an image corresponding to one scan width is printed again.

An image is printed (formed) by repeating such conveyance of the printing sheet 106 and such an operation of discharging ink from the printhead 101 onto the printing sheet 106. Note that a printing apparatus to which the present invention can be applied is not limited to the above serial printing type apparatus. For example, the present invention can also be applied to a so-called full-line type printing apparatus which disposes printheads in the conveying direction of a printing sheet and prints in synchronism with the conveyance of the printing sheet.

Figure 2:
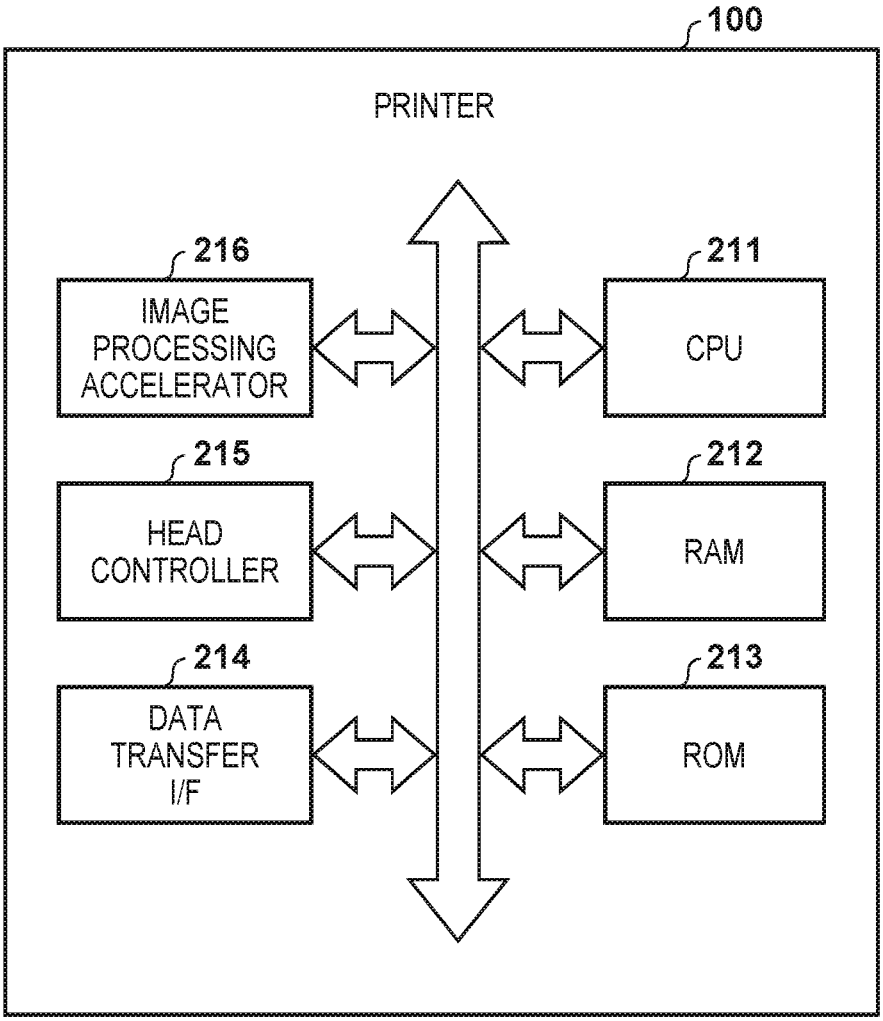
FIG. 2 is a block diagram showing an example of the hardware arrangement of the printer according to the first embodiment.

FIG. 2 shows an example of the hardware arrangement of an inkjet printer according to this embodiment. A CPU 211 executes, for example, each processing described later in accordance with programs held in a ROM 213 and a RAM 212. The RAM 212 is a volatile storage (storage area), which temporarily holds programs and data. The ROM 213 is a nonvolatile storage, which holds table data generated by each processing described later and programs. A data transfer I/F 214 controls the transmission/reception of data to/from an external apparatus such as a PC (Personal Computer), smartphone, tablet terminal, or server. It is possible to use USB, IEEE1394, LAN, or the like as a connection scheme for this data transmission/reception in accordance with a connection partner. A head controller 215 supplies print data to the printhead 101 shown in FIG. 1 and controls the discharging operation of the printhead 101. More specifically, the head controller 215 reads control parameters and print data from predetermined addresses in the RAM 212. When the CPU 211 writes control parameters and print data at predetermined addresses in the RAM 212, the head controller 215 activates processing to cause the printhead 101 to discharge ink.

An image processing accelerator 216 is implemented by hardware, and executes image processing faster than the CPU 211. More specifically, the image processing accelerator 216 reads parameters and data necessary for image processing from predetermined addresses in the RAM 212. When the CPU 211 writes the parameters and the data at predetermined addresses in the RAM 212, the image processing accelerator 216 is activated to perform predetermined image processing. Note that the image processing accelerator 216 is not always a necessary element, and the above processing of generating table parameters and the above image processing may be performed by only the CPU 211 depending on the specifications of the printer.

[Bias of Use of Ink]

The bias of the use of ink in an integrated tank will be described below. First of all, separate tanks which can be separately set for the respective colors allow tank replacement for each color, and hence can be efficiently used as compared with an integrated tank. In contrast to this, when using an integrated tank including ink of a plurality of colors, the bias of the use of ink by the user will cause a waste in ink which has not been consumed to a certain extent at the time of tank replacement. An integrated tank is basically required to be replaced with a new tank when ink of any one of the colors runs out. When using an integrated tank containing, for example, inks of four colors, namely C (Cyan), M (Magenta), Y (Yellow), and K (black), the user who frequently prints color pictures consumes large amounts of C ink, M ink, and Y ink. In this case, if K ink has not been consumed to a certain extent, K ink left in the tank is wasted at the time of tank replacement. In contrast to this, the user who frequently prints documents including many black characters will waste C ink, M ink, and Y ink left in the tank at the time of tank replacement, if the C ink, M ink, and Y ink have not been consumed to a certain extent. A situation in which the remaining amounts of inks of the respective colors have a bias as a result of consuming ink of one color or inks of a plurality of colors by amount larger than the consumed amounts of inks of the remaining colors will be referred as "uneven consumption of inks" hereinafter. In addition, assume that in the description of this specification, an ink tank is synonymous with a tank.

In printing using an integrated tank, if there is a bias in ink used by the user, ink of a color which is unevenly frequently used is consumed fast. This may increase the replacement frequency of ink tanks. In a service to automatically deliver interchangeable consumables, an increase in the replacement frequency of ink tanks may lead to deterioration in convenience for a user, such as an increase in the number of times of delivery and an increase in the number of times of setting ink tanks.

Figure 3:
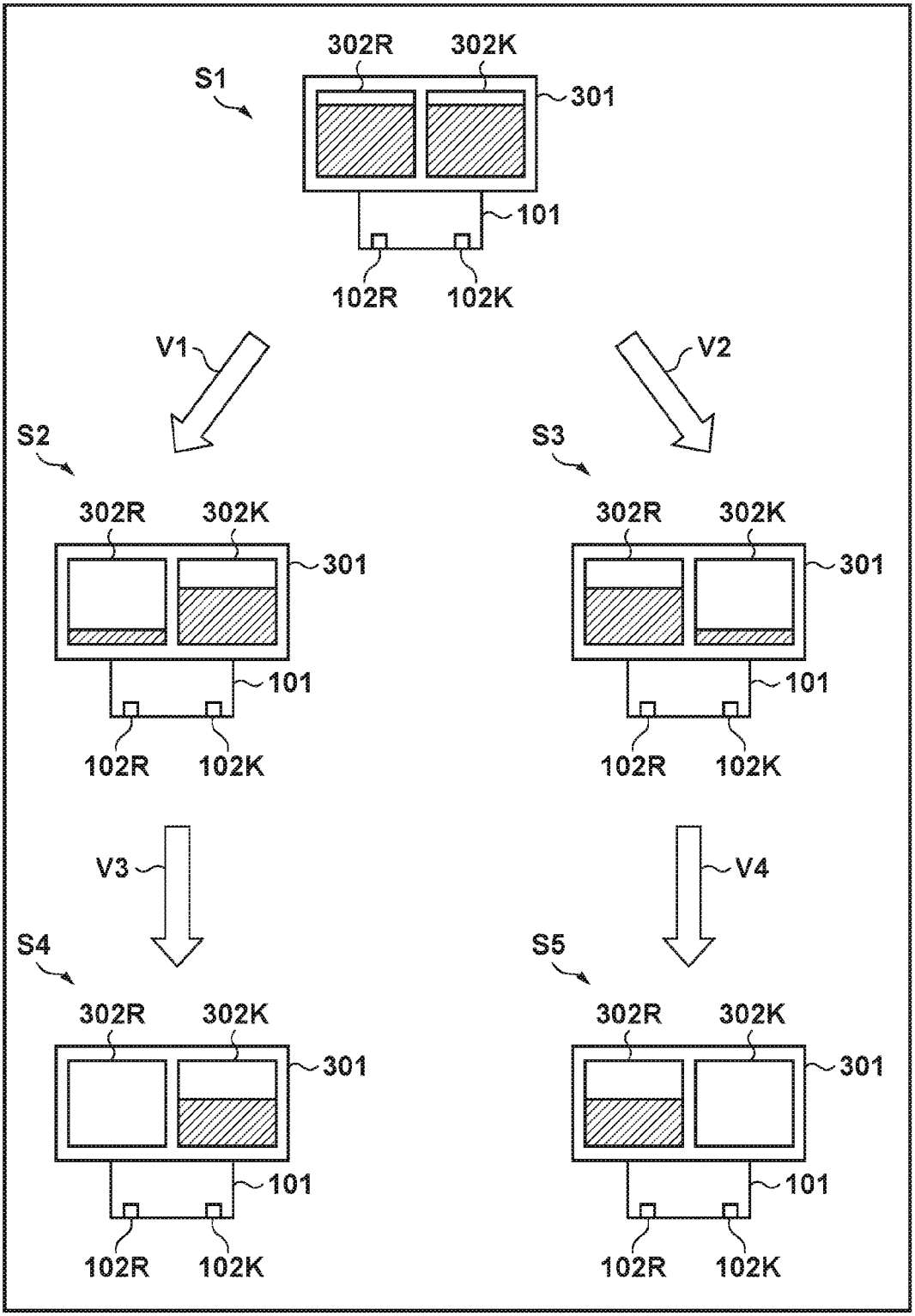
FIG. 3 is a view for explaining the uneven consumption of inks.

FIG. 3 is a view for explaining uneven consumption of inks in an integrated tank. In FIG. 3, S1 indicates the remaining amounts of inks immediately after an integrated tank 301 is attached to the printhead 101. Both red ink 302R and black ink 302K are almost full. In this case, when the user has printed a certain number of pages of originals mainly using the red ink 302R by using the printhead 101, a transition represented by V1 occurs, and the state changes to the state indicated by S2 in FIG. 3. In contrast to this, when the user has printed a certain number of pages of originals mainly using the black ink 302K by using the printhead 101, a transition represented by V2 occurs, and the state changes to the state indicated by S3 in FIG. 3.

In FIG. 3, S4 indicates the remaining amounts of inks after the user has printed a certain number of pages of originals mainly using the red ink 302R by using the printhead 101. The remaining amount of the red ink 302R is small, and a tank to replace next must be prepared. On the other hand, the remaining amount of the black ink 302K is larger than that of the red ink 302R. If the user keeps printing in this state, a transition represented by V3 occurs, and the state changes to the state indicated by S4 in FIG. 3. As a result, the red ink 302R runs out, but the remaining amount of the black ink 302K is considerably large. If tank replacement is performed in this state, the remaining black ink 302K is discarded.

In FIG. 3, S3 indicates the remaining amounts of inks after the user has printed a certain number of pages of originals mainly using the black ink 302K by using the printhead 101. The remaining amount of the black ink 302K is small, and a tank to replace next must be prepared. On the other hand, the remaining amount of the red ink 302R is larger than that of the black ink 302K. If the user keeps printing in this state, a transition represented by V4 occurs, and the state changes to the state indicated by S5 in FIG. 3. As a result, the black ink 302K runs out, but the remaining amount of the red ink 302R is considerably large. If tank replacement is performed in this state, the remaining red ink 302R is discarded.

When providing (delivering) an integrated tank in a service to automatically deliver interchangeable consumables, uneven consumption of inks will cause an increase in delivery cost. That is, to discard a tank containing a large amount of unused ink (remaining ink) is to decrease the number of copies that can be printed by the printer to an extent corresponding the ink wasted. This makes it necessary for the user to frequently replace tanks, and hence increases the load on the user. In addition, every tank replacement accompanies a delivery cost.

If, for example, the size of the integrated tank 301 can be infinitively increased, uneven consumption of inks poses no problem in a service to automatically delivering integrated tanks. That is, if the amount of ink of each color can be sufficiently increased by increasing the ink tank size, it is possible to suppress the replacement frequency of ink tanks even at the occurrence of uneven consumption of inks. In practice, however, the size of an ink tank is limited by the size of the printer main body to which the ink tank is attached. For this reason, when using an ink tank with a practical size which can be accommodated in the printer main body, the following means is an effective means for suppressing the replacement frequency of ink tanks. This means is to provide a user with a suitable ink tank selected from a plurality of ink tanks differing in the ratios between the amounts of inks of the respective colors in accordance with how the user performs printing. That is, when there is a bias in ink used by the user, uneven consumption of inks can be reduced by providing the user with an integrated tank in which the amount of ink used more frequently is high in ratio. This can reduce the amount of ink discarded unused at the time of tank replacement and allows more efficient use of ink of each color in the tank.

This can increase the number of copies that can be printed before ink runs out and allows the user to reduce the replacement frequency of tanks. This can therefore reduce the possibility of increasing the load on the user. In addition, it is possible to reduce the delivery cost in an automatic delivery service. Furthermore, it is possible to reduce the ink cost by the amount of ink discarded. Note that in the following description, the ratio between the amounts of inks of the respective colors in an integrated tank will be referred to as the "constituent ratio of inks". In order to increase the effect of reducing the replacement frequency of ink tanks, it is preferable to maximize the total amount of ink in each tank. For this reason, the following description will be made on the assumption that the total amounts of inks in the respective tanks are almost the same.

Figure 4:
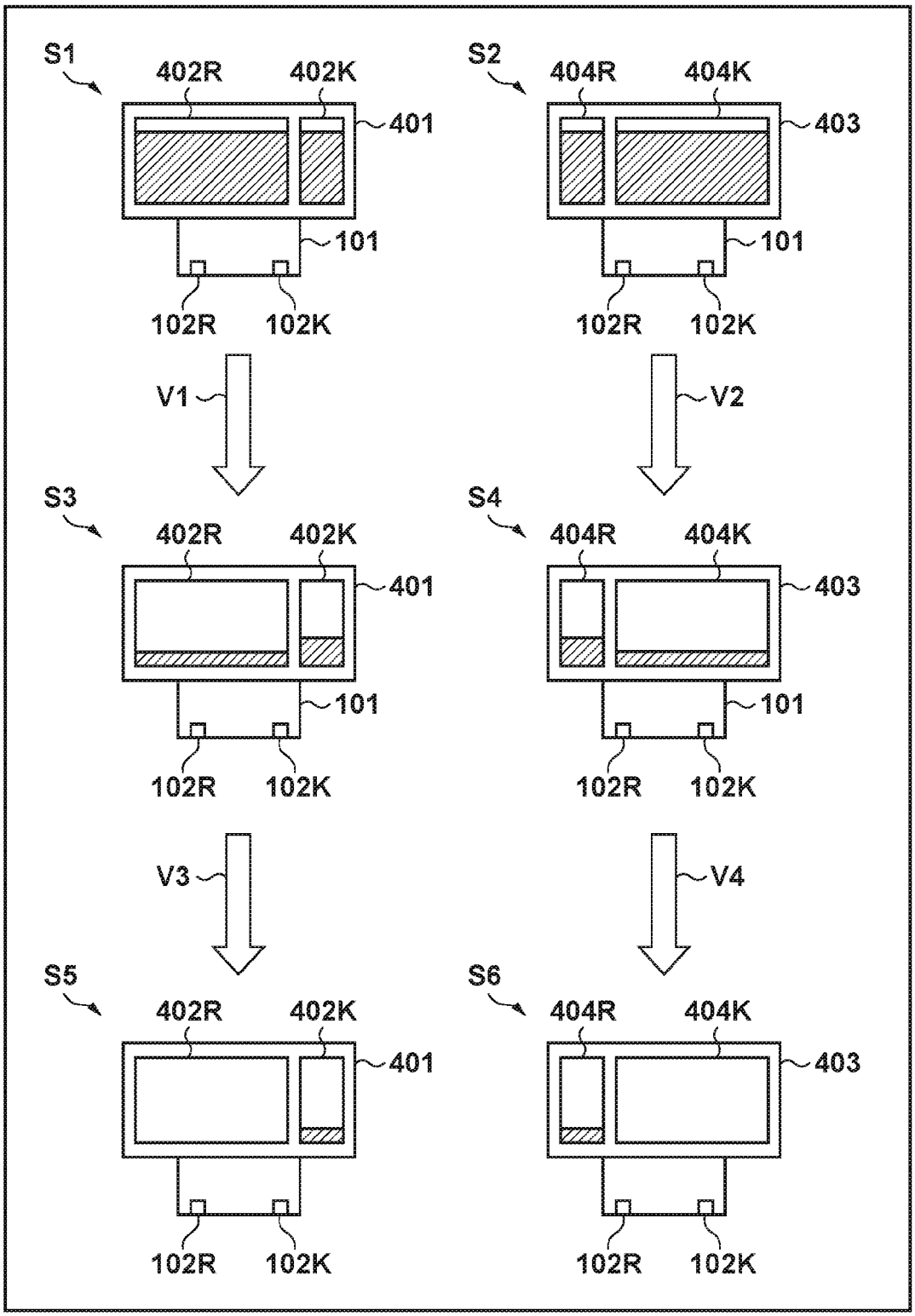
FIG. 4 is a view for explaining how to reduce the uneven consumption of inks.

FIG. 4 is a view for explaining that it is possible to reduce the uneven consumption of inks described with reference to FIG. 3 by changing the constituent ratio between the red ink 302R and the black ink 302K contained in the integrated tank 301.

In FIG. 4, S1 indicates the remaining amounts of inks immediately after an integrated tank 401 is attached to the printhead 101. Although the total amount of ink in the integrated tank 401 is almost equal to that in the integrated tank 301 in FIG. 3, the constituent ratio between red ink 402R and black ink 402K inside the tank differs from that in the integrated tank 301. In the integrated tank 301, the constituent ratio between the red ink 302R and the black ink 302K is almost 1:1. In contrast to this, the integrated tank 401 contains the red ink 402R more than the black ink 402K. At the time of S1 in FIG. 4, the respective types of inks are almost full. In this case, when the user has printed a certain number of pages of originals mainly using the red ink 402R by using the printhead 101, a transition represented by V1 occurs, and the state changes to the state indicated by S3 in FIG. 4.

In FIG. 4, S3 indicates the remaining amounts of inks after the user has printed a certain number of pages of originals mainly using the red ink 402R by using the printhead 101. The remaining amount of the red ink 402R is small, and a tank to replace next must be prepared. The remaining amount of the black ink 402K is smaller than that indicated by S2 in FIG. 3. If the user keeps printing in this state, a transition represented by V3 occurs, and the state changes to the state indicated by S5 in FIG. 4. The remaining amount of the black ink 402K at the time when the red ink 402R runs out is smaller than that indicated by S4 in FIG. 3. In this case, when performing tank replacement, the amount of the black ink 402K discarded is smaller than that indicated by S4 in FIG. 3. Since the total amount of red ink and black ink indicated by S1 in FIG. 3 is almost equal to that indicated by S1 in FIG. 4, the number of copies that can be printed per tank increases. This makes it possible for the user to reduce the replacement frequency of tanks and hence to reduce the possibility of increasing the load on the user. In addition, it is possible to suppress a delivery cost in an automatic consumable delivery service. The following description will be made on the assumption that reducing uneven consumption of inks in an integrated tank is equivalent to reducing the delivery cost in an automatic integrated tank delivery service.

In FIG. 4, S2 indicates the remaining amounts of inks immediately after an integrated tank 403 is attached to the printhead 101. In contrast to the case indicated by S1 in FIG. 4, the tank contains black ink 404K more than red ink 404R. At the time of S2 in FIG. 4, the respective types of inks are almost full. In this case, when the user has printed a certain number of pages of originals mainly using the black ink 404K by using the printhead 101, a transition represented by V2 occurs, and the state changes to the state indicated by S4 in FIG. 4.

In FIG. 4, S4 indicates the remaining amounts of inks after the user has printed a certain number of pages of originals mainly using the black ink 404K by using the printhead 101. The remaining amount of the black ink 404K is small, and a tank to replace next must be prepared. The remaining amount of the red ink 404R is smaller than that indicated by S3 in FIG. 3. If the user keeps printing in this state, a transition represented by V4 occurs, and the state changes to the state indicated by S6 in FIG. 4. The remaining amount of the red ink 404R at the time when the black ink 404K runs out is smaller than that indicated by S5 in FIG. 3. In this case, when performing tank replacement, the amount of the red ink 404R discarded is smaller than that indicated by S5 in FIG. 3.

This embodiment implements the following to reduce uneven consumption of inks in an integrated tank:

- providing an integrated tank into which a large amount of red ink is injected for a user who uses a large amount of red ink;
- providing an integrated tank into which almost equal amounts of red ink and black ink are injected for a user who uses almost equal amounts of red ink and black ink; and
- providing an integrated tank into which a large amount of black ink is injected for a user who uses a large amount of black ink.

Although the total amount of red ink and black ink contained in an integrated tank and the ratio of each ink to the total amount are not specifically limited, it is possible to use a plurality of types of integrated tanks with different total amounts and different containing ratios (constituent ratios) of the respective types of inks.

A method according to this embodiment will be described in detail below. Note that the embodiment will exemplify a case in which the following three types of two-color integrated tanks each containing red ink and black ink:

- a red rich tank (Red_Rich) containing red ink more than black ink;
- a standard tank (Std) containing almost equal amounts of red ink and black ink; and
- a black rich tank (Bk_Rich) containing black ink more than red ink.

As described above, the above ink colors are examples, and it is possible to use ink of other colors and other combinations of ink.

[Software Arrangement]

Figure 5A:
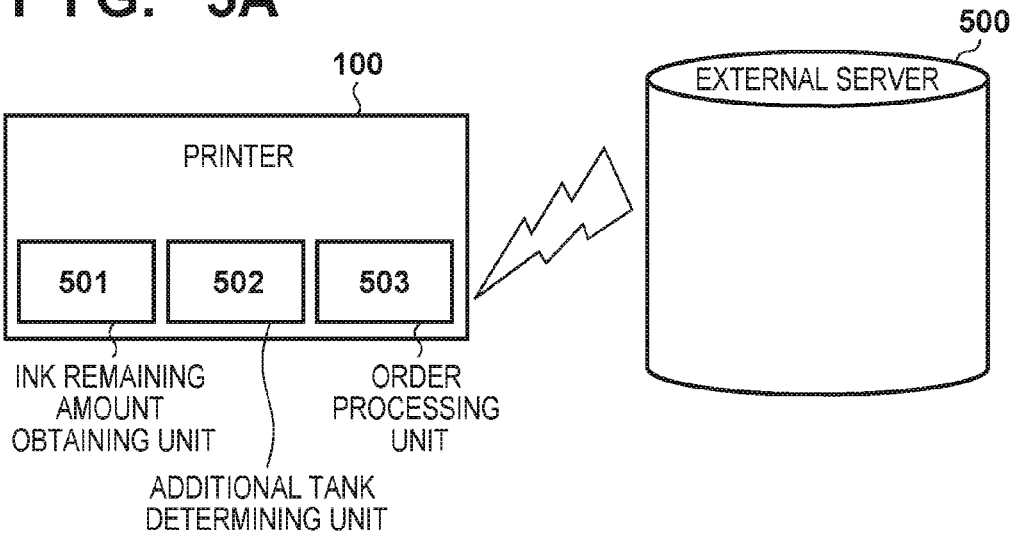
FIGS. 5A, 5B, and 5C are views each showing an example of the software arrangement of a system according to the first embodiment.
Figure 5B:
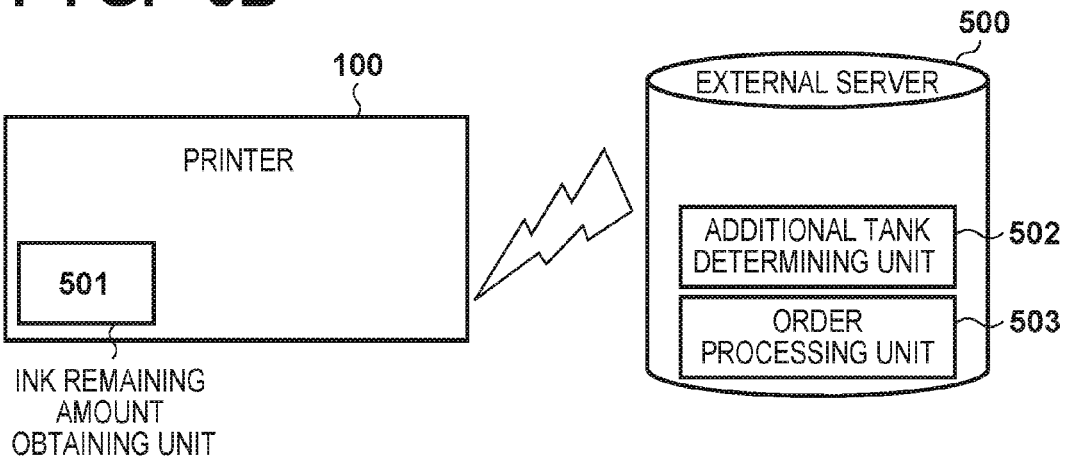
Figure 5C:
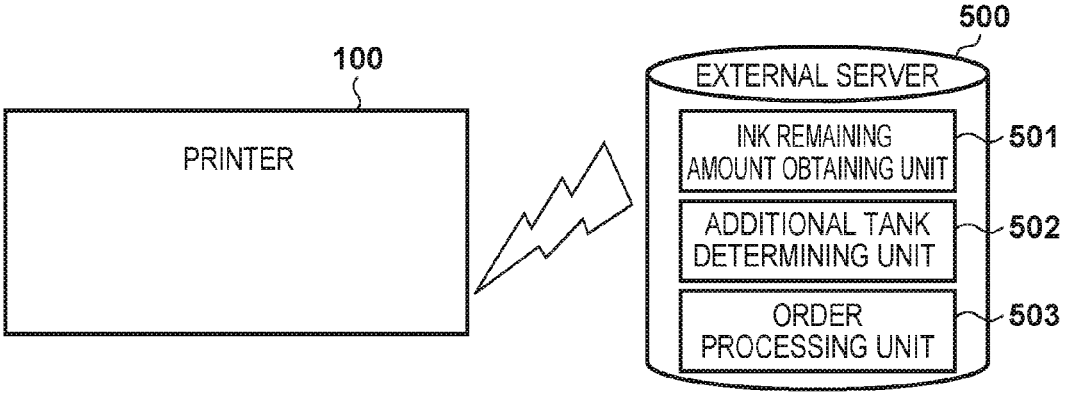

FIGS. 5A to 5C are views each showing an example of the software arrangement of a system according to this embodiment. That is, these drawings show that the system according to the embodiment includes a printer and an external server, and also show which one of them is made to execute processing according to the embodiment.

Referring to FIG. 5A, the printer 100 includes an ink remaining amount obtaining unit 501, an additional tank determining unit 502, and an order processing unit 503. The ink remaining amount obtaining unit 501 obtains information (consumption information) concerning the remaining amount of ink or the consumption amount of ink of the printer 100. The additional tank determining unit 502 determines the next interchangeable ink tank based on the information obtained by the ink remaining amount obtaining unit 501. Assume that the additional tank determining unit 502 manages information about integrated tanks which can be used by the printer 100. Assume that in this embodiment, the additional tank determining unit 502 manages information about the above three types of tanks. The order processing unit 503 accesses an external server 500 via the data transfer I/F 214 and a communication network such as the Internet, and sends the order information of an interchangeable ink tank to the external server 500. In this case, order information is information including information for uniquely identifying a user or printer and information about an interchangeable ink tank. This information is required to deliver an interchangeable ink tank to the user. Information for identifying a user or printer is, for example, ID information such as a user ID or printer ID or position information for specifying the position of a printer.

User information is preferably registered in the external server 500 in advance. User information includes, for example, a user ID for specifying a user, the name, address, or contract address of the user, and the model name or printer ID of a printer in use. The external server 500 associates order information sent from the printer 100 and pre-registered user information to make an arrangement to deliver an interchangeable ink tank to the user. Note that in this arrangement, the external server 500 may manage information about an integrated tank which can be used by the printer 100. In this embodiment, this information corresponds to information about the above three types of tanks. For example, the external server 500 notifies a delivery company of the type of interchangeable ink tank and the address of a user and issues an instruction to deliver. In accordance with this instruction, the delivery company delivers an interchangeable ink tank to the user. In addition, user information may be included in order information.

As another example of software arrangement, as shown in FIG. 5B, the external server 500 may have the additional tank determining unit 502 and the order processing unit 503 instead of the printer 100. In this case, the printer 100 sends information concerning the remaining amount of ink or the consumed amount of ink obtained by the ink remaining amount obtaining unit 501 and ID information such as a user ID or printer ID to the external server 500 via the data transfer I/F 214. The external server 500 determines a next interchangeable ink tank based on the information concerning the remaining amount of ink or the consumed amount of ink by using the additional tank determining unit 502 and the order processing unit 503. The external server 500 then processes an order for an interchangeable ink tank with respect to the user specified from the ID information.

In addition, as still another example of the software arrangement, as shown in FIG. 5C, the external server 500 may include the ink remaining amount obtaining unit 501, the additional tank determining unit 502, and the order processing unit 503. A preferred example of the software arrangement shown in FIG. 5C includes a case in which when printing an image saved in the external server 500, the external server 500 performs the processing procedure shown in FIG. 6 (to be described later). In this case, the printer 100 sends information concerning the remaining amount of ink or the consumed amount of ink to the external server 500 in accordance with a request from the external server 500.

[Processing Procedure]

Figure 6:
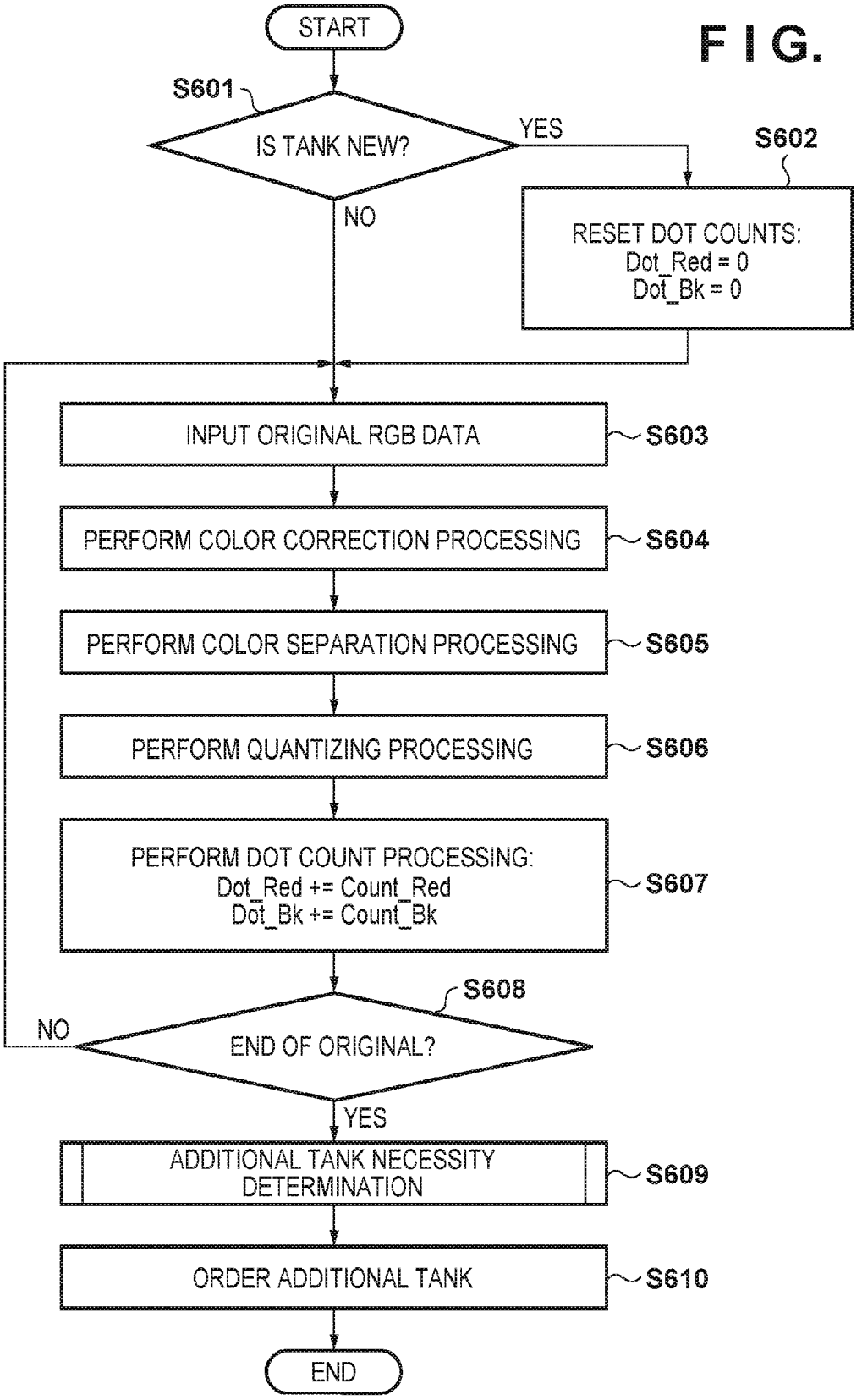
FIG. 6 is a flowchart for printing processing according to the first embodiment.

FIG. 6 is a flowchart for printing processing according to the first embodiment. The following will exemplify the software arrangement shown in FIG. 5A. Therefore, the CPU 211 of the printer 100 implements this processing procedure by reading out and executing programs stored in the ROM 213 or the like.

When this processing procedure starts, the CPU 211 determines in step S601 whether the attached tank is new (that is, a tank containing unused ink). If the CPU 211 determines that a new tank has just been attached (YES in step S601), the process advances to step S602. If the CPU 211 determines that the attached tank is not a new tank (NO in step S601), the process advances to step S603.

In step S602, the CPU 211 resets the number of dots printed by the attached tank. In this case, variables Dot_Red and Dot_Bk respectively represent the cumulative dot counts (cumulative values) of red ink and black ink after tank replacement. If the attached tank is not a new tank but is a continuously used tank, previously print dot counts are continuously used.

In steps S603 to S608, the CPU 211 actually processes the image data of an original and prints an image on a sheet. In step S603, the CPU 211 inputs an RGB image of the original. In step S604, the CPU 211 performs color correction processing for converting the RGB colors of the original into RGB values suited to printing. This color correction processing may be known suitable processing. In step S605, the CPU 211 performs color separation processing for converting the RGB values into the usages of red ink and black ink of the printhead 101. This color separation processing technique may use known preferred processing.

In step S606, the CPU 211 performs quantizing processing for converting the usage of ink of each color in the printhead 101 into information representing the presence/absence of each dot to be actually printed. This quantizing processing may be performed by using known error diffusion processing, dither processing, or the like. When the quantized dot data is sent to the printhead 101 and the preparation of dot data corresponding to one scan is complete, actual printing (image formation) is performed on the printing sheet 106 by using the printhead 101.

In step S607, the CPU 211 performs the accumulation processing of counting the numbers of dots corresponding to the respective colors in the following manner based on the dot data quantized for the printhead 101.

```
Dot_Red+=Count_Red

Dot_Bk+=Count_Bk
```

where Count_Red and Count_Bk respectively represent print dot counts of red ink and black ink in the printhead 101. In this embodiment, for the sake of convenience, no consideration is given to the consumption of inks other than ink printed on the printing sheet 106. However, considering elements such as the consumption of ink discharged outside the printing sheet 106 can improve the accuracy of estimation of the remaining amounts of inks.

In step S608, the CPU 211 determines whether processing is complete for all the pixels of the original. If the processing is complete (YES in step S608), the process advances to step S609. If the processing is not complete (NO in step S608), the process returns to step S603 to repeat the processing.

In step S609, the CPU 211 determines whether it is necessary to prepare the next interchangeable ink tank. Additional tank necessity determination processing in step S609 will be described in detail later with reference to FIGS. 7A and 7B. Upon determining in step S609 that it is necessary to prepare an ink tank, the CPU 211 performs order processing for an ink tank in step S610. Thereafter, the CPU 211 terminates this processing procedure.

(Additional Tank Necessity Determination Processing)

The additional tank necessity determination processing in step S609 in FIG. 6 will be described in detail below with reference to FIGS. 7A and 7B.

In steps S701 and S702, the CPU 211 determines the type of ink tank currently attached to the printer 100. Tank_Type represents the type of ink tank currently attached to the printer 100. If Tank_Type represents a red rich tank (Red_Rich), the process advances to step S703. If Tank_Type represents a standard tank (Std), the process advances to step S713. If Tank_Type represents a black rich tank (Bk_Rich), the process advances to step S723.

Processing to be performed when the determination result indicates a red rich tank (Red_Rich) will be described. In steps S703 to S707, the CPU 211 determines the remaining amount level of red ink. Rem_Red represents a value indicating the remaining amount level of red ink. In this embodiment, the remaining amount level is determined as one of three levels, namely level 0, level 1, and level 2. Level 0 indicates a level at which the remaining amount of ink is small, and ink tank replacement preparation is necessary. Levels 1 and 2 are levels at which the remaining amounts of ink are larger than that at level 0, and ink tank replacement preparation is not yet necessary. Level 2 is a level at which the remaining amount of ink is larger than that at level 1. That is, the relationship between the remaining amounts of ink at the respective levels is expressed as level 2>level 1>level 0. Thresholds Th_Red_1*a* and Th_Red_1*b* are thresholds for determining the remaining amount of ink. In this case, each threshold is used with respect to the number of printed dots (the consumed amount of ink). In addition, the relationship between the thresholds is expressed as Th_Red_1*a*>Th_Red_1*b*.

In step S703, the CPU 211 compares Dot_Red with the threshold Th_Red_1*a*. If Dot_Red is larger than the threshold Th_Red_1*a* (YES in step S703), the process advances to step S704. Otherwise (NO in step S703), the process advances to step S705. In step S704, the CPU 211 sets Rem_Red to 0. The process then advances to step S708.

In step S705, the CPU 211 compares Dot_Red with the threshold Th_Red_1*b*. If Dot_Red is larger than the threshold Th_Red_1*b* (YES in step S705), the process advances to step S706. Otherwise (NO in step S705), the process advances to step S707.

In step S706, the CPU 211 sets Rem_Red to 1. The process then advances to step S708. In step S707, the CPU 211 sets Rem_Red to 2. The process then advances to step S708.

In steps S708 to S712, the CPU 211 determines the remaining amount level of black ink. Rem_Bk represents a value indicating the remaining amount level of black ink. A determination method in this case is the same as that for red ink. That is, the CPU 211 compares Dot_Bk with thresholds Th_Bk_1*a* and Th_Bk_1*b*, and sets 0, 1, or 2 to Rem_Bk. In this case, the relationship between the thresholds is expressed as threshold Th_Bk_1*a*>threshold Th_Bk_1*b*.

If Tank_Type represents a standard tank (Std) or a black rich tank (Bk_Rich), the remaining amount levels of the respective types of inks are obtained by the same method as described above. That is, upon determining that the current tank is a standard tank (Std) (YES in step S702), the CPU 211 sets Rem_Red and Rem_Bk in steps S713 to S722. Likewise, upon determining that the current tank is a black rich tank (Bk_Rich) (NO in step S702), the CPU 211 sets Rem_Red and Rem_Bk in steps S723 to S732. Note that the CPU 211 determines the respective thresholds used in processing in steps S713 to S722 and processing in steps S723 to S732 in accordance with the capacity of each ink tank. Like the processing in steps S703 to S712, the relations between the respective thresholds are expressed as Th_Red_2*a*>Th_Red_2*b*, Th_Bk_2*a*>Th_Bk_2*b*, Th_Red_3*a*>Th_Red_3*b*, and Th_Bk_3*a*>Th_Bk_3*b*.

In step S733, the CPU 211 determines whether it is necessary to prepare an interchangeable ink tank in accordance with a combination of Rem_Red and Rem_Bk. In addition, upon determining that an interchangeable ink tank is required, the CPU 211 determines which type of tank is suitable. After this determination, the CPU 211 terminates this processing procedure.

An example of the determination method used in step S733 will be described in detail below, together with a method of calculating the thresholds used in steps S703 to S732. The breakdown of the amounts of inks of the respective colors in a red rich tank (Red_Rich), a standard tank (Std), and a black rich tank (Bk_Rich) is set as follows:

- a red rich tank (Red_Rich): the amount of red ink is almost twice that of black ink;
- a standard tank (Std): the amount of red ink is almost equal to that of black ink; and
- a black rich tank (Bk_Rich): the amount of black ink is almost twice that of red ink.

Assume that in this case, the total amounts of inks in the above three types of tanks are almost equal.

In addition, assume that determination conditions for determining suitable interchangeable ink tanks include conditions 1 to 3 defined as follows:

(Condition 1) If both the remaining amount level of red ink (Rem_Red) and the remaining amount level of black ink (Rem_Bk) are 0, an ink tank identical to the attached ink tank is provided.

(Condition 2) If either of the remaining amount level of red ink (Rem_Red) and the remaining amount level of black ink (Rem_Bk) is 0, (Condition 2-1) If the consumed amount of ink whose remaining amount level is not 0 is less than ½ that of ink whose remaining amount level is 0, a tank rich (~_Rich) with ink whose consumed amount is large; and (Condition 2-2) Otherwise, a standard tank (Std) is provided.

(Condition 3) If both the remaining amount level of red ink (Rem_Red) and the remaining amount level of black ink (Rem_Bk) are not 0, it is determined that no interchangeable ink tank is required.

A reason for setting condition 1 is that if the remaining amount levels of all the types of inks are 0, it can be determined that the currently attached ink tank is suitable for the manner of usage by the user. A reason for setting condition 2-1 is that if a bias in the usage of ink becomes twice or more, it can be determined that an ink tank containing frequently used ink twice or more in amount is suitable for the manner of usage by the user. A reason for setting condition 2-2 is that if a bias in the usage of ink is less than twice, it can be determined that a standard tank is suitable for the manner of usage by the user.

Figure 8A:
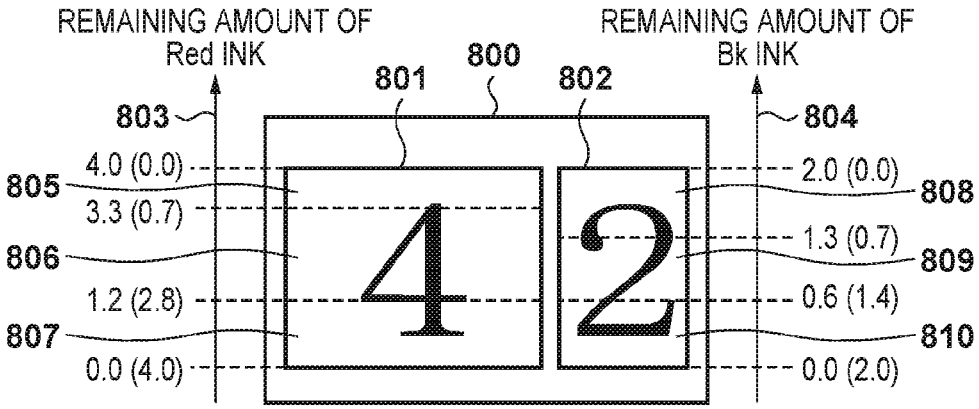
FIGS. 8A, 8B and 8C are views for explaining thresholds used for additional tank necessity determination according to the first embodiment.
Figure 8B:
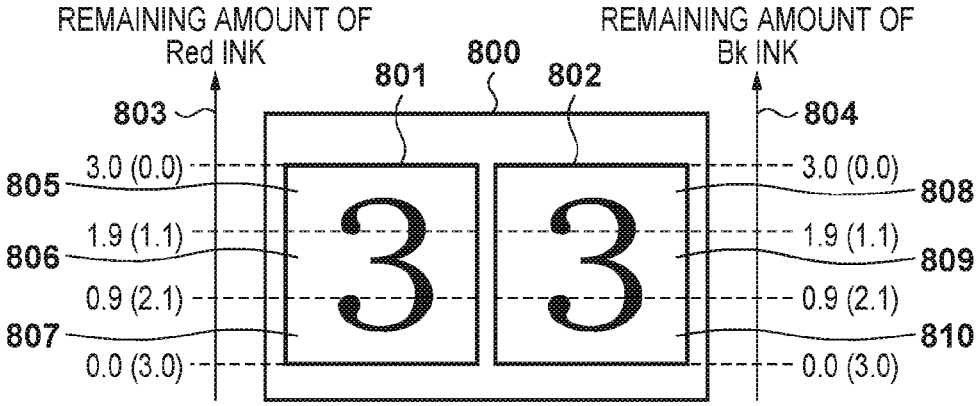
Figure 8C:
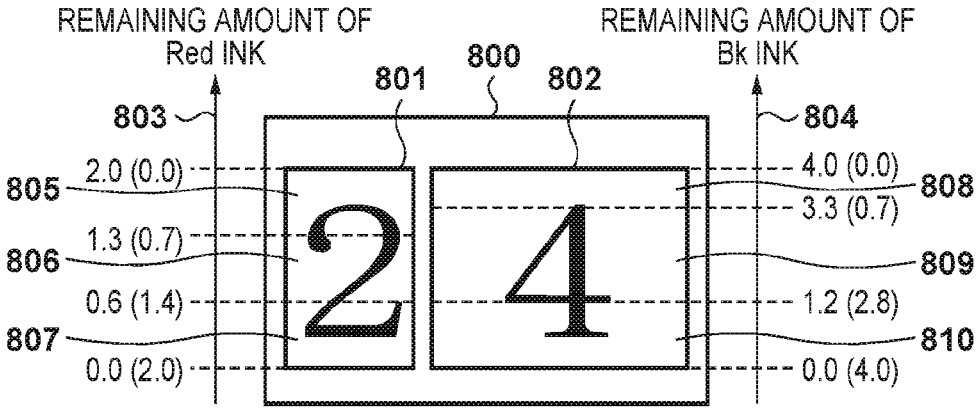

FIGS. 8A, 8B, and 8C are views for explaining a method of calculating thresholds to be set in steps S703 to S732 to implement the above conditions. FIGS. 8A to 8C are views for explaining the setting of thresholds for a red rich tank (Red_Rich), a standard tank (Std), and a black rich tank (Bk_Rich).

Referring to FIGS. 8A to 8C, an ink tank 800 includes red ink 801 and black ink 802. In addition, the numbers written in the illustrations of the red ink 801 and the black ink 802 indicate the amounts of inks of the respective colors in a full state. For the sake of easy understanding, assume that the total amount of ink in each tank is 6. In this case, in a red rich tank (Red_Rich) in FIG. 8A, the amount of red ink and the amount of black ink in a full state are respectively 4 and 2. In a standard tank (Std) in FIG. 8B, the amount of red ink and the amount of black ink in a full state are respectively 3 and 3. In a black rich tank (Bk_Rich) in FIG. 8C, the amount of red ink and the amount of black ink in a full state are respectively 2 and 4.

The number on the left of each set of parentheses on an axis 803 indicates the remaining amount of red ink, and the number on the left of each set of parentheses on an axis 804 indicates the remaining amount of black ink. In addition, the numbers in the respective parentheses on the axes 803 and 804 indicate the usages of the respective types of inks. That is, the numerical value on the left of each set of parentheses indicates the remaining amount of the corresponding ink when used by an amount corresponding to the numerical value in the parentheses. Therefore, the sum of the number on the left of each set of parentheses on each of the axes 803 and 804 and the number in the parentheses indicates the amount of ink in a full state.

Figure 7A:
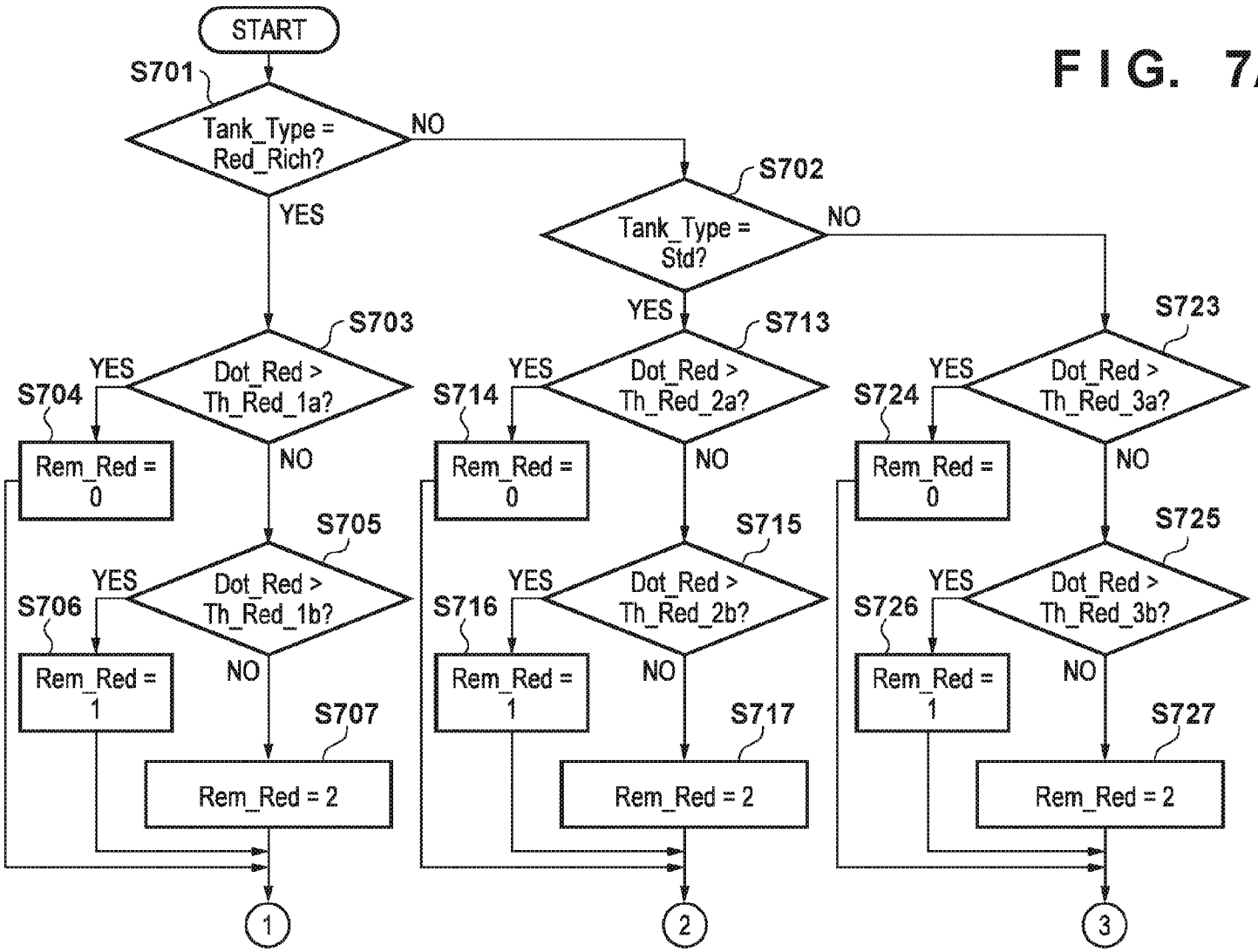
FIGS. 7A and 7B are flowcharts for additional tank necessity determination processing according to the first embodiment.
Figure 7B:
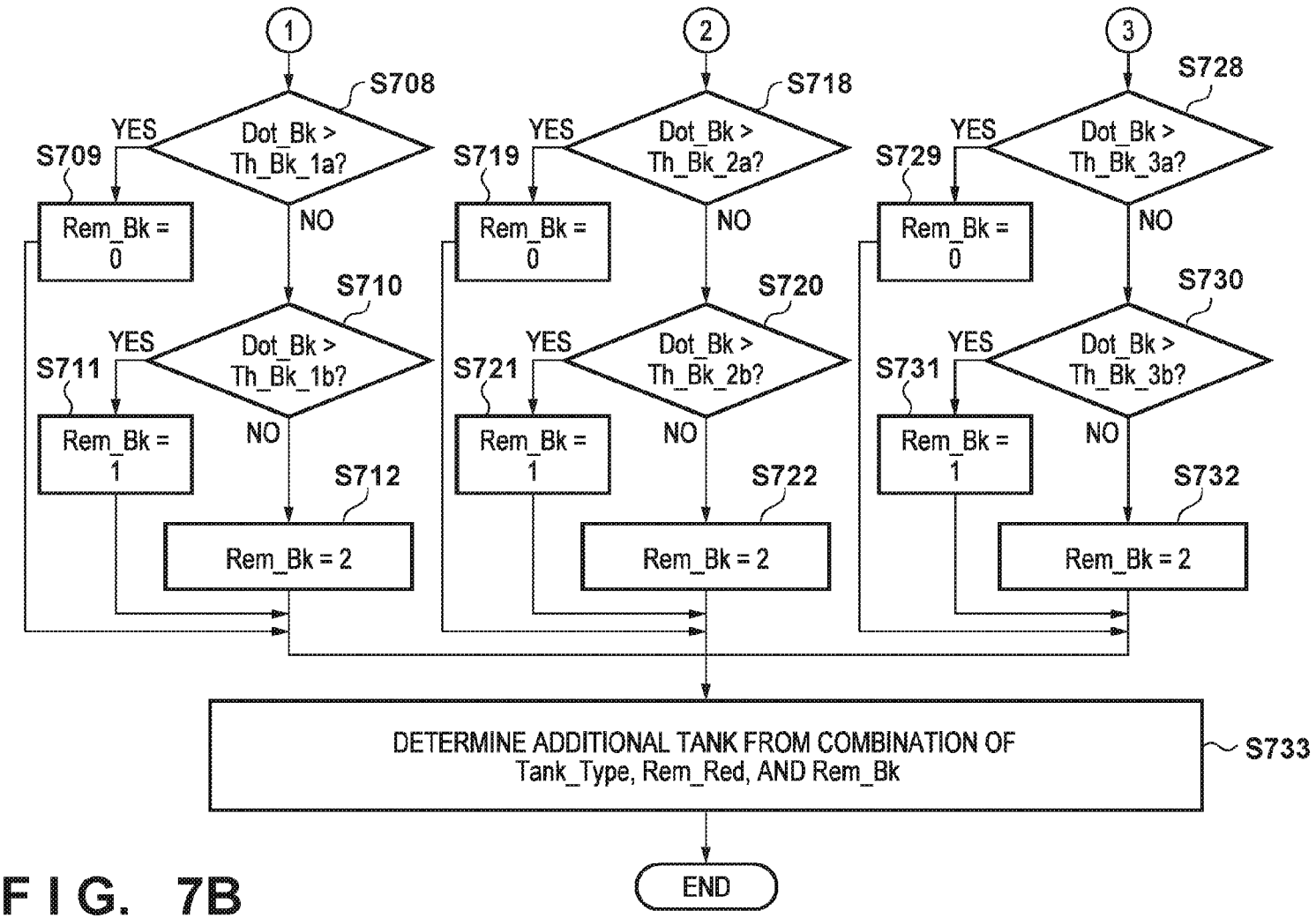

Referring to FIGS. 8A to 8C, regions 805 to 807 correspond to the respective remaining amount levels Rem_Red of red ink in FIGS. 7A and 7B. For example, referring to FIG. 8A, when the remaining amount of red ink is 3.3 or more (corresponding to the region 805), Rem_Red=2 (level 2). When the remaining amount of red ink is 1.2 or more and less than 3.3 (corresponding to the region 806), Rem_Red=1 (level 1). When the remaining amount of red ink is less than 1.2 (corresponding to the region 807), Rem_Red=0 (level 0).

Likewise, regions 808 to 810 correspond to the respective remaining amount levels Rem_Bk of black ink in FIGS. 7A and 7B. For example, referring to FIG. 8A, when the remaining amount of black ink is 1.3 or more (corresponding to the region 808), Rem_Bk=2 (level 2). When the remaining amount of black ink is 0.6 or more and less than 1.3 (corresponding to the region 809), Rem_Bk=1 (level 1). When the remaining amount of black ink is less than 0.6 (corresponding to the region 810), Rem_Bk=0 (level 0).

Referring to FIGS. 8B and 8C, the remaining amount levels of inks of the respective colors are set based on the written remaining amount values of inks of the respective colors in the same manner as described above. In any case, remaining amount level 0 at which ink replacement preparation is required corresponds to a case in which the remaining amount of ink of each color becomes less than 30% of the amount of ink in a full state. On the other hand, referring to FIGS. 8A and 8C, with regard to the setting of the thresholds between level 1 and level 2, the ratio between red ink and black ink is changed from that in a full state. Note that the setting of thresholds is not limited to the above.

As described above, in order to implement the states shown in FIGS. 8A to 8C, thresholds to be set in the procedure shown in FIGS. 7A and 7B may be obtained as follows:

$$Th_Red_1a = Red_max_1 \times 2.8/4.0$$

$$Th_Red_1b = Red_max_1 \times 0.7/4.0$$

$$Th_Bk_1a = Bk_max_1 \times 1.4/2.0$$

$$Th_Bk_1b = Bk_max_1 \times 0.7/2.0$$

$$Th_Red_2a = Red_max_2 \times 2.1/3.0$$

$$Th_Red_2b = Red_max_2 \times 1.1/3.0$$

$$Th_Bk_2a = Bk_max_2 \times 2.1/3.0$$

$$Th_Bk_2b = Bk_max_2 \times 1.1/3.0$$

$$Th_Red_3a = Red_max_3 \times 1.4/2.0$$

$$Th_Red_3b = Red_max_3 \times 0.7/2.0$$

$$Th_Bk_3a = Bk_max_3 \times 2.8/4.0$$

$$Th_Bk_3b = Bk_max_3 \times 0.7/4.0$$

Red_max_1 is a constant representing the maximum number of dots that can be printed in red ink when the red rich tank is full. Bk_max_1 is a constant representing the maximum number of dots that can be printed in black ink when the red rich tank is full. Likewise, Red_max_2 is a constant representing the maximum number of dots that can be printed in red ink when the standard tank is full. Bk_max_2 is a constant representing the maximum number of dots that can be printed in black ink when the standard tank is full. In addition, Red_max_3 is a constant representing the maximum number of dots that can be printed in red ink when the black rich tank is full. Bk_max_3 is a constant representing the maximum number of dots that can be printed in black ink when the black rich tank is full. Each constant is determined by the size of a corresponding ink tank, the discharge rate of the printhead 101, and the like.

FIG. 9 is a table for explaining the determination method in step S733 and its determination results. This table describes the type of interchangeable ink tank required next in accordance with each combination of the type of ink tank (Tank_Type) attached to the printer 100, the remaining amount of red ink (Rem_Red), and the remaining amount (Rem_Bk) of black ink. In any case, an interchangeable ink tank needs to be prepared when at least Rem_Red or Rem_Bk is 0. In other cases, since condition 3 is satisfied, the table describes "-" indicating that no interchangeable ink tank required. Cases requiring the preparation of interchangeable ink tanks will be described in detail below separately for each tank type.

A case in which the ink tank currently attached to the printer is a red rich tank (Tank_Type=Red_Rich) will be described.

1. When Rem_Red=0 and Rem_Bk=0, condition 1 is satisfied, and the next interchangeable ink tank is a red rich tank (Red_Rich).

2. When Rem_Red=0 and Rem_Bk=1, condition 2-1 is satisfied, and the next interchangeable ink tank is a red rich tank (Red_Rich).

3. When Rem_Red=0 and Rem_Bk=2, condition 2-1 is satisfied, and the next interchangeable ink tank is a red rich tank (Red_Rich).

4. When Rem_Red=1 and Rem_Bk=0, condition 2-2 is satisfied, and the next interchangeable ink tank is a standard tank (Std).

5. When Rem_Red=2 and Rem_Bk=0, condition 2-1 is satisfied, and the next interchangeable ink tank is a black rich tank (Bk_Rich).

A case in which the ink tank currently attached to the printer is a standard tank (Tank_Type=Std) will be described.

1. When Rem_Red=0 and Rem_Bk=0, condition 1 is satisfied, and the next interchangeable ink tank is a standard tank (Std).

2. When Rem_Red=0 and Rem_Bk=1, condition 2-2 is satisfied, and the next interchangeable ink tank is a standard tank (Std).

3. When Rem_Red=0 and Rem_Bk=2, condition 2-1 is satisfied, and the next interchangeable ink tank is a red rich tank (Red_Rich).

4. When Rem_Red=1 and Rem_Bk=0, condition 2-2 is satisfied, and the next interchangeable ink tank is a standard tank (Std).

5. When Rem_Red=2 and Rem_Bk=0, condition 2-1 is satisfied, and the next interchangeable ink tank is a black rich tank (Bk_Rich).

A description of a case in which the ink tank currently attached to the printer is a black rich tank (Tank_Type=Bk_Rich) will be omitted. This case is equivalent to the case in which the ink tank currently attached is the red rich tank (Tank_Type=Red_Rich) with Red being interchanged with Bk.

Note that one of the determination results shown in FIG. 9 may be directly used as a determination result in step S733 or further determination may be performed by using history information in addition to such a determination result.

FIG. 10 is a table for explaining an example of adding determination using history information in step S733. Referring to FIG. 10, the next interchangeable ink tank is determined based on a combination of three types of ink tanks, namely the ink tank determined based on the table shown in FIG. 9 as a next interchangeable ink tank candidate, the previously attached ink tank, and the currently attached ink tank. The total number of combinations is 3×3×3=27 because the previous ink tank, the current ink tank, and the next (candidate) ink tank each take three types of ink tanks, namely a red rich tank (Red_Rich), a standard tank (Std), and a black rich tank (Bk_Rich). The determination conditions shown in FIG. 10 are based on conditions 4 to 6 described below. The next (candidate) ink tanks in this table indicate the determination results shown in FIG. 9.

(Condition 4) If the previous, current, and next (candidate) ink tanks include both a red rich tank (Red_Rich) and a black rich tank (Bk_Rich), a standard tank (Std) is provided.

(Condition 5) If there is no previous ink tank information and condition 4 is not satisfied, an ink tank is provided base on the next (candidate) ink tank determination result.

(Condition 6) If neither condition 4 nor condition 5 is satisfied, an ink tank listed twice or more in the "previous", "current", and "next (candidate)" columns is provided.

A reason for setting condition 4 is that since the manner of usage of ink by the user exhibits no specific tendency, it can be determined that a standard tank is suitable for the manner of usage by the user. A reason for setting condition 5 is that if the user uses the printer for the first time or history information is lost for some reason, it can be determined that the result of determination based on the manner of current usage is suitable for the manner of usage by the user. A reason for setting condition 6 is that if there is a bias in the manner of usage of ink by the user, it can be determined that a tank of a type that reflects the bias is suitable for the manner of usage by the user in terms of probability.

Note that the determination result obtained by each operation may be stored as history information to set information concerning the previously attached ink tank and the currently attached ink tank so as to allow the information to be used for determination in step S733. Alternatively, the type of ink tank actually attached to the printer may be stored as history information so as to allow the information to be used for determination in step S733. Assume that the additional tank determining unit 502 stores history information concerning the attachment of the previous and current tanks in a storage area at the time of tank determination or replacement.

The association between FIGS. 5A to 5C and 6 will be described. In the form in which the printer 100 includes the ink remaining amount obtaining unit 501, the additional tank determining unit 502, and the order processing unit 503, as shown in FIG. 5A, the printer 100 executes steps S601 to S610 in the procedure shown in FIG. 6. In the form in which the printer 100 includes the ink remaining amount obtaining unit 501, and the external server 500 includes the additional tank determining unit 502 and the order processing unit 503, as shown in FIG. 5B, the printer 100 executes steps S601 to S608 in the procedure shown in FIG. 6, and the external server 500 executes steps S609 and S610. In the form in which the external server 500 includes the ink remaining amount obtaining unit 501, the additional tank determining unit 502, and the order processing unit 503, as shown in FIG. 5C, the external server 500 executes steps S601 to S610 in the procedure shown in FIG. 6. According to the description made with reference to FIG. 6, the CPU 211 of the printer 100 implements the procedure shown in FIG. 6 by reading out and executing programs stored in the ROM 213 or the like. However, different CPUs are used in the respective cases. For example, in the case shown in FIG. 5B, the CPU 211 implements the processing in steps S601 to S608 by reading out and executing programs stored in the ROM 213 or the like. Meanwhile, the CPU of the external server 500 implements steps S609 and S610 by reading out and executing programs stored in the ROM of the external server. In the case shown in FIG. 5C, the CPU of the external server 500 implements steps S601 to S610 by reading out and executing programs stored in the ROM of the external server.

In this embodiment, the ink tanks and the printhead are described as separate devices which are detachable from each other. However, it is possible to use a so-called disposable head obtained by integrating ink tanks with a printhead. In addition, for the sake of easy understanding, in the embodiment, the number of types of integrated tanks is set to three. However, this is not exhaustive. Even if four or more types of integrated tanks are used, the same effect as described above can be obtained by increasing the number of thresholds described with reference to FIGS. 7 and 8A to 8C. Furthermore, for the sake of easy understanding, the ink amount constituent ratios inside the three types of integrated tanks each are set to almost 1:1 or almost 1:2. However, this is not exhaustive. With other arbitrary ink amount constituent ratios, the same effect as described above can be obtained by changing the values of the thresholds described with reference to FIGS. 7 and 8A to 8C.

In addition, in this embodiment, in order to increase the effect of reducing the replacement frequency of ink tanks, the total amounts of inks of all the colors in the three types of integrated tanks are set to almost the same amount. However, this is not exhaustive. The respective types of tanks may differ in the total amount of ink of all the colors in accordance with the physical properties of the respective types of inks, such as concentration, a color separation method, and the like. Even if a plurality of types of integrated tanks with different total ink amounts are used, the same effect as described above can be obtained by changing the values of the thresholds described with reference to FIGS. 7 and 8A to 8C. Furthermore, the embodiment uses the dot count value of each type of ink as information concerning the remaining amount of ink or the consumed amount of ink. However, this is not exhaustive. It is possible to directly detect the remaining amount of ink by using an existing method such as a method using an optical sensor or pressure sensor.

In addition, in this embodiment, a plurality of integrated tanks with different constituent ratios between the respective types of inks inside the tanks may be implemented by changing the positions of interior walls for separating the respective types of inks inside the tanks. Alternatively, such integrated tanks may be implemented by changing the injection amounts of respective types of inks without changing the positions of the interior walls for separating the respective types of inks inside the tanks. The latter technique of changing ink amount constituent ratios by changing the injection amounts is effective, for example, in a case in which limitations are imposed on the total amount of ink when controlling a motor for scanning the printhead. In mainly a disposable head, when it is necessary to change the shape of the channel from a tank to each nozzle by changing the position of an interior wall for separating the respective types of inks from each other in the tank, it is necessary to properly perform channel design for each type of head. With any implementation method, it is possible to obtain the same effect as that in this embodiment.

Second Embodiment

In the first embodiment, an integrated tank contains inks of the two colors, namely red ink and black ink. However, more types of inks may be used. The second embodiment will exemplify an integrated tank containing inks of three colors, namely cyan (C), magenta (M), and yellow (Y). Like the first embodiment, the second embodiment will exemplify the following four types of tanks:

- a standard tank (Std) containing almost equal amounts of cyan ink, magenta ink, and yellow ink;
- a cyan rich tank (C_Rich) containing more cyan ink than magenta ink and yellow ink;
- a magenta rich tank (M_Rich) containing more magenta ink than cyan ink and yellow ink; and
- a yellow rich tank (Y_Rich) containing more yellow ink than magenta ink and cyan ink.

The difference from the first embodiment will be mainly described, while a description of common portions will be omitted. The difference between the arrangement of the second embodiment and the arrangement shown in FIG. 1 in the first embodiment is that a printhead 101 is equipped with a plurality of nozzles for discharging cyan ink, magenta ink, and yellow ink.

In the second embodiment, the processing performed for each of red ink and black ink in the first embodiment is performed for each of cyan ink, magenta ink, and yellow ink in the overall processing procedure. The following is the difference from the procedure in FIG. 6. Dot count reset processing performed in step S602 is represented by Dot_C=0, Dot_M=0, and Dot_Y=0. Dot_C, Dot_M, and Dot_Y respectively represent the cumulative dot counts of cyan ink, magenta ink, and yellow ink after tank replacement. Color separation processing in step S605 is performed to convert RGB values into the usages of cyan ink, magenta ink, and yellow ink. This color separation processing technique may use known preferred processing.

Quantizing processing in step S606 is performed with respect to the usages of C ink, M ink, and Y ink. This quantizing processing may be performed by using any method such as known error diffusion processing or dither processing. Dot count accumulating processing in step S607 is performed as follows:

$$\text{Dot_}C\text{+=Count_}C$$

$$\text{Dot_}M\text{+=Count_}M$$

$$\text{Dot_}Y\text{+=Count_}Y$$

where Count_C, Count_M, and Count_Y respectively represent the print dot counts of cyan ink, magenta ink, and yellow ink of the printhead 101.

Additional tank necessity determination processing in step S609 is performed based on combinations of the remaining amount levels (Rem_C, Rem_M, and Rem_Y) of the respective types of inks and the type (Tank_Type) of the ink tank currently attached to the printer. A detailed procedure is almost the same as that shown in FIGS. 7A and 7B, and hence a description of it will be omitted. In this embodiment, the remaining amount level (Rem_C) of cyan ink, the remaining amount level (Rem_M) of magenta ink, and the remaining amount level (Rem_Y) of yellow ink may be obtained with respect to four types of Tank_Type.

Additional tank determination processing corresponding to step S733 and a method of calculating thresholds used for determining the remaining amount levels of the respective types of inks will be described next with reference to examples. First of all, the breakdown of the amounts of inks of the respective colors is set as follows in the same manner as in the first embodiment:

- a standard tank (Std): the amount of cyan ink, the amount of magenta ink, and the amount of yellow ink are almost equal;
- a cyan rich tank (C_Rich): the amount of cyan ink is almost twice that of ink of each of other colors;
- a magenta rich tank (M_Rich): the amount of magenta ink is almost twice that of ink of each of other colors; and
- a yellow rich tank (Y_Rich): the amount of yellow ink is almost twice that of ink of each of other colors.

Assume that the total amounts of inks in the above four types of tanks are almost equal. For the sake of easy understanding of the following description, a cyan rich tank (C_Rich), magenta rich tank (M_Rich), and yellow rich tank (Y_Rich) will be collectively referred to as a rich tank (~_Rich). In addition, in a rich tank, ink whose amount is larger than those of other types of inks is called large ink, and other types of inks are called small inks. For example, in a cyan rich tank, cyan ink is large ink, and magenta ink and yellow ink are small inks. Ink in a standard tank will be collectively referred to as standard ink to discriminate it from the above ink.

Assume that determination conditions for determining a suitable interchangeable ink tank are set as conditions 7 to 10 according to this embodiment, as follows:

(Condition 7) If all the remaining amount level of cyan ink (Rem_C), the remaining amount level of magenta ink (Rem_M), and the remaining amount level of yellow ink (Rem_Y) are 0, an ink tank identical to the currently attached ink tank is provided.

(Condition 8) If two of remaining amount level of cyan ink (Rem_C), the remaining amount level of magenta ink (Rem_M), and the remaining amount level of yellow ink (Rem_Y) are 0, (Condition 8-1) If the remaining amount level of large ink is 0 and the consumed amount of small ink whose remaining amount level is not 0 is less than ½ that of large ink, an ink tank identical to the currently attached ink tank is provided; and (Condition 8-2) Otherwise, a standard tank (Std) is provided.

(Condition 9) If one of the remaining amount level of cyan ink (Rem_C), the remaining amount level of magenta ink (Rem_M), and the remaining amount level of yellow ink (Rem_Y) is 0, (Condition 9-1) If the consumed amount of ink whose remaining amount level is not 0 is less than ½ that of ink whose remaining amount level is 0, a rich tank (~_Rich) containing ink of a color whose consumed amount is the largest (that is, ink whose remaining amount level is 0) is provided; and (Condition 9-2) Otherwise, a standard tank (Std) is provided.

(Condition 10) If none of the remaining amount level of cyan ink (Rem_C), the remaining amount level of magenta ink (Rem_M), and the remaining amount level of yellow ink (Rem_Y) are 0, no interchangeable ink tank replacement is required.

A reason for setting condition 7 is that if the remaining amount levels of all the types of inks are 0, it can be determined that the currently attached ink tank is suitable for the manner of usage by the user. A reason for setting conditions 8-1 and 9-1 is that if a bias in the usage of ink becomes twice or more, it can be determined that an ink tank containing frequently used ink twice or more in amount is suitable for the manner of usage by the user. A reason for setting conditions 8-2 and 9-2 is that if a bias in the usage of ink is less than twice, it can be determined that a standard tank is suitable for the manner of usage by the user.

In order to implement the above determination conditions, it is necessary to determine the remaining amount levels of the respective types of inks. A threshold setting method for this is almost the same as that in the first embodiment.

Figure 11A:
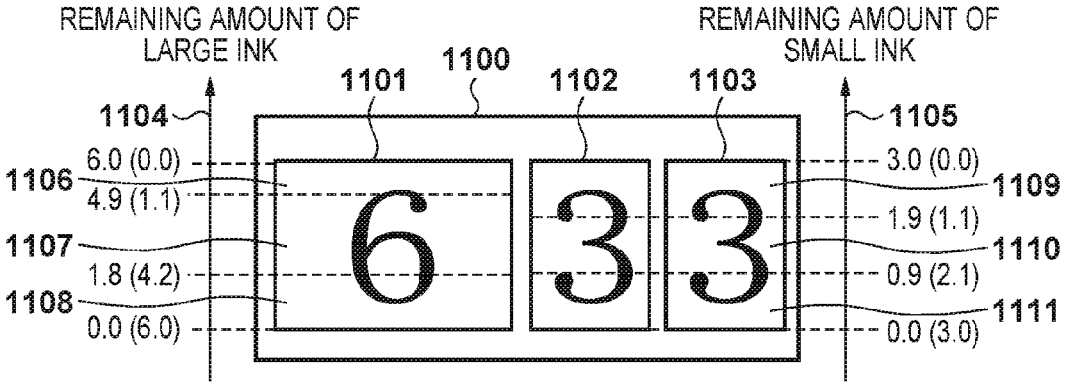
FIGS. 11A and 11B are views for explaining thresholds used for additional tank necessity determination according to the second embodiment.
Figure 11B:
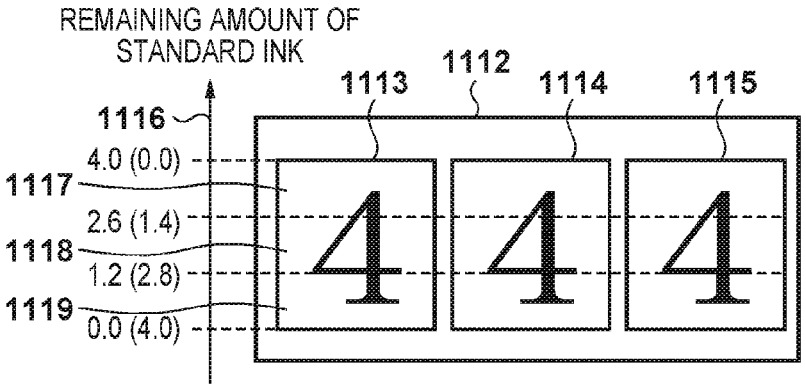

FIGS. 11A and 11B are views for explaining an example of the threshold setting method according to this embodiment, and respectively correspond to FIGS. 8A to 8C in the first embodiment. FIGS. 11A and 11B respectively correspond to a rich tank (~_Rich) and a standard tank (Std). FIG. 11A shows large ink 1101 and two small inks 1102 and 1103 in a rich tank (~_Rich) 1100. FIG. 11B shows three standard inks 1113, 1114, and 1115 in a standard tank 1112. The numbers written in the illustrations of the respective types of inks indicate the amounts of inks of the respective colors in a full state. For the sake of easy understanding, assume that the total amount of inks in each tank is 12. The number on the left of each set of parentheses on an axis 1104 indicates the remaining amount of large ink, and the number on the left of each set of parentheses on an axis 1105 indicates the remaining amount of small ink. In addition, the number on the left of each set of parentheses on an axis 1116 indicates the remaining amount of standard inks. In addition, the numbers in the parentheses on the axes indicate the usages of the respective types of inks. That is, the numerical value on the left of each set of parentheses indicates the remaining amount of the corresponding ink when used by an amount corresponding to the numerical value in the parentheses.

Regions 1106 to 1108 respectively correspond to the remaining amount levels of large ink. The regions 1106, 1107, and 1108 respectively correspond to remaining amount level 2, remaining amount level 1, and remaining amount level 0. Regions 1109 to 1111 respectively correspond to the remaining amount levels of small inks. The regions 1109, 1110, and 1111 respectively correspond to remaining amount level 2, remaining amount level 1, and remaining amount level 0. In addition, the regions 1117 to 1119 respectively correspond to the respective remaining amount levels of standard inks. The regions 1117, 1118, and 1119 respectively correspond to remaining amount level 2, remaining amount level 1, and remaining amount level 0. Referring to FIG. 11A, with regard to the setting of the thresholds between level 1 and level 2, the ratios between large ink and small ink are changed from those in a full state. Note that the setting of thresholds is not limited to the above.

Thresholds for cyan ink, magenta ink, and yellow ink are calculated, using the numerical values in FIGS. 11A and 11B, by the same method as that performed based on FIGS. 8A to 8C in the first embodiment. A description of each specific calculation method will be omitted.

FIG. 12 shows the type of interchangeable ink tank required next in accordance with a combination of the remaining amount levels of the respective types of inks (Rem_C, Rem_M, and Rem_Y) and the type of ink tank (Tank_Type) currently attached to the printer. FIG. 12 corresponds to FIG. 9 in the first embodiment. Although a determination method corresponding to FIG. 12 is the same as that in the first embodiment, the method according to the second embodiment uses conditions 7 to 10. A description of each specific determination method will be omitted.

Even when using an integrated tank containing inks of three colors, the same effect as that in the first embodiment can be obtained. A similar method can be applied to even an integrated tank containing more types of inks.

Third Embodiment

The second embodiment has exemplified the integrated tank containing inks of three colors. The third embodiment will exemplify a four-color integrated tank. Assume that the four colors are cyan (C), magenta (M), yellow (Y), and black (Bk). Using the same method as that in the second embodiment can provide an integrated tank suitable for the manner of usage by the user. However, the above method uses five types of tanks including a standard tank because a rich tank (~_Rich) must be provided for each type of ink. This may complicate a manufacturing line for tanks and a management method for tanks. For this reason, this embodiment handles inks other than black ink, namely cyan ink, magenta ink, and yellow ink, as color ink (Col) as a whole. That is, the embodiment handles a plurality of integrated tanks with different constituent ratios between three types of color inks (the total amount of cyan ink, magenta ink, and yellow ink) and black ink. This arrangement can suppress the number of types of tanks to about ⅓. In addition, an integrated tank containing a large amount of color inks is provided to the user who prints pictures, and an integrated tank containing a large amount of black ink is provided to the user who prints documents. This makes it possible to reduce the amount of ink discarded at the time of tank replacement as compared with the case in which standard tanks are uniformly provided. This embodiment will exemplify a case in which the following three types of tanks are provided as in the first embodiment:

- a color rich tank (Col_Rich) containing more color inks than black ink;
- a standard tank (Std) containing almost equal amounts of color inks and black ink; and
- a black rich tank (Bk_Rich) containing more black ink than color inks.

The breakdown of the amounts of color inks in each tank is not specifically limited. The amounts of cyan ink, magenta ink, and yellow ink may be almost equal or the amount of a specific type of ink may be set to a relatively large amount in accordance with ink physical properties such as ink concentration, a color separation method, and the like. This embodiment will be described based on the assumption that the amounts of cyan ink, magenta ink, and yellow ink are almost equal.

The difference from the first embodiment will be mainly described, while a description of common portions will be omitted.

A difference from the arrangement shown in FIG. 1 in the first embodiment is that a printhead 101 is equipped with a plurality of nozzles for discharging cyan ink, magenta ink, yellow ink, and black ink.

Figure 13:
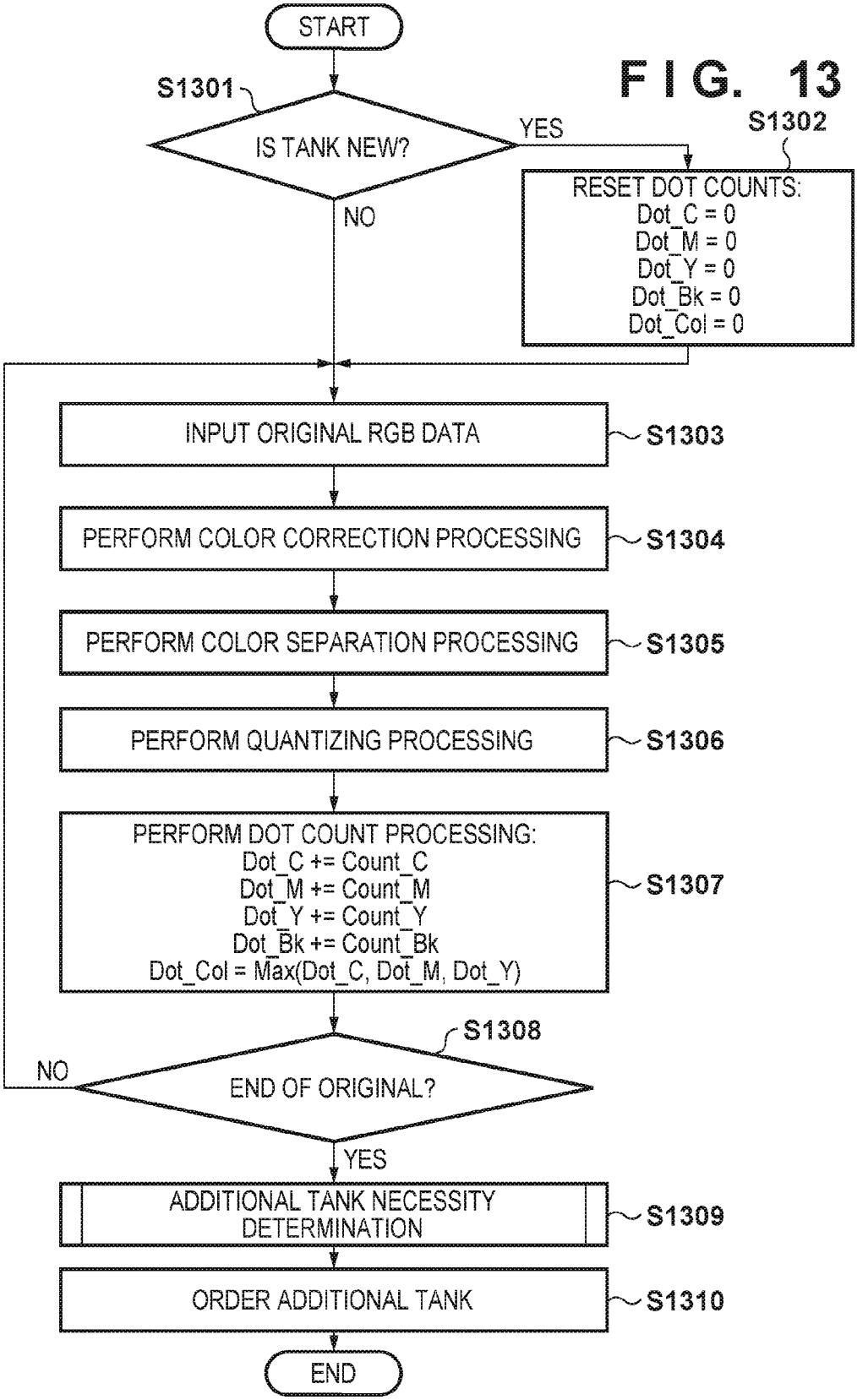
FIG. 13 is a flowchart for printing processing according to the third embodiment.

An overall processing procedure according to this embodiment will be described with reference to FIG. 13. Since the processing arrangement is almost the same as that shown in FIG. 6, differences from the procedure shown in FIG. 6 will be described. Dot count reset processing performed in step S1302 is represented by Dot_C=0, Dot_M=0, Dot_Y=0, Dot_Bk=0, and Dot_Col=0. In this case, Dot_C=0, Dot_M=0, Dot_Y=0, and Dot_Bk=0 respectively represent the cumulative dot counts of cyan ink, magenta ink, yellow ink, and black ink after tank replacement. In addition, Dot_Col takes the maximum value among the cumulative dot counts of cyan ink, magenta ink, and yellow ink. A function MAX( ) is a function of outputting the maximum value among a plurality of arguments. Dot_Col is calculated by MAX (Dot_C, Dot_M, Dot_Y).

Color separation processing in step S1305 is performed to convert RGB values into the usages of cyan ink, magenta ink, yellow ink, and black ink of the printhead. As a color separation processing technique, known suitable processing may be used. Quantizing processing in step S1306 is performed with respect to the usages of respective types of inks, namely cyan ink, magenta ink, yellow ink, and black ink. This quantizing processing may be performed by using any method such as known error diffusion processing or dither processing. Dot count accumulation processing in step S1307 is performed as follows:

$$\text{Dot_}C\text{+=Count_}C$$

$$\text{Dot_}M\text{+=Count_}M$$

$$\text{Dot_}Y\text{+=Count_}Y$$

$$\text{Dot_Bk+=Count_Bk}$$

$$\text{Dot_Col=MAX(Dot_}C\text{,Dot_}M\text{,Dot_}Y\text{)}$$

where Count_C, Count_M, Count_Y, and Count_Bk respectively represent the print dot counts of cyan ink, magenta ink, yellow ink, and black ink of the printhead.

Figure 14A:
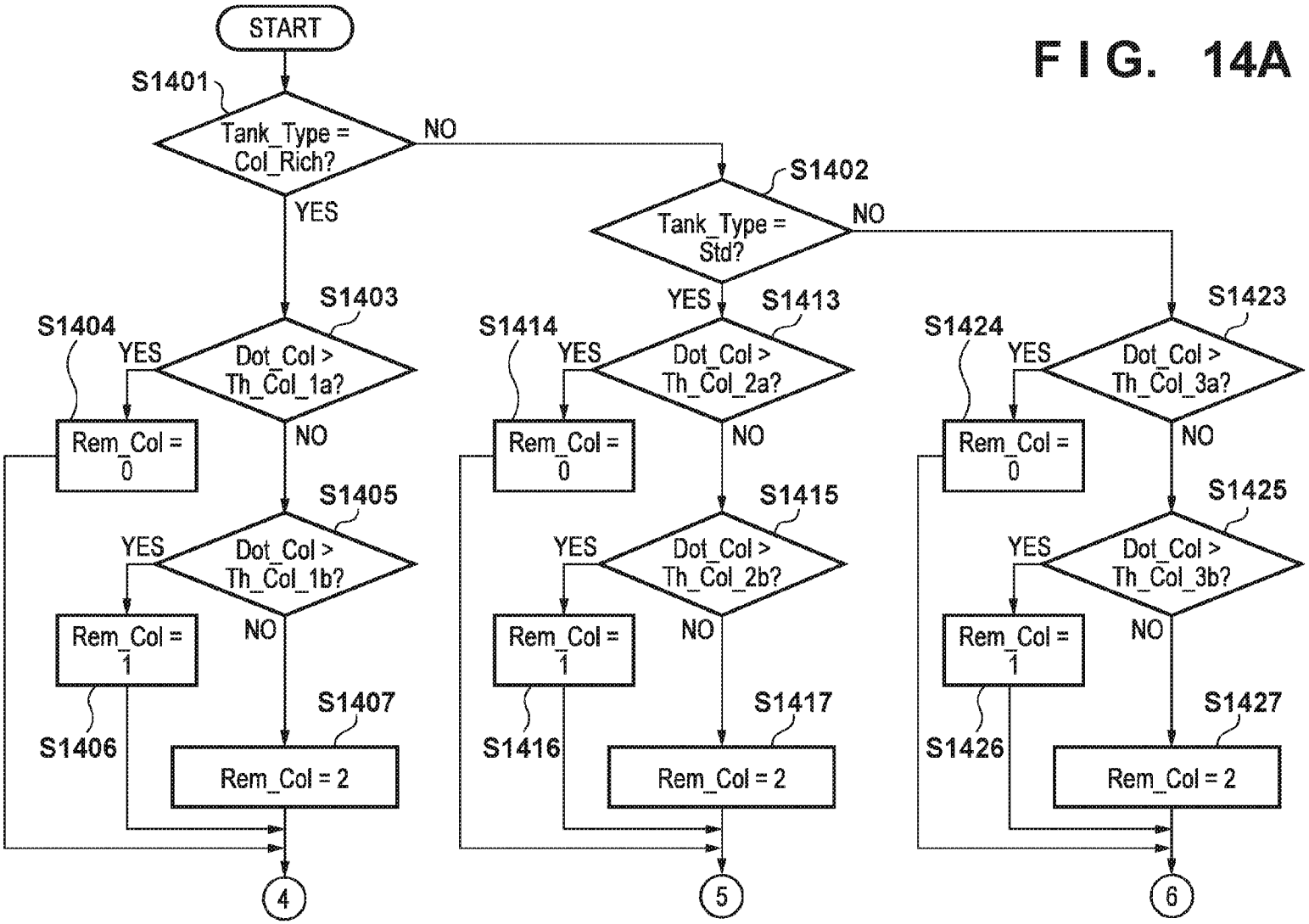
FIGS. 14A and 14B are flowcharts for additional tank necessity determination processing according to the third embodiment.
Figure 14B:
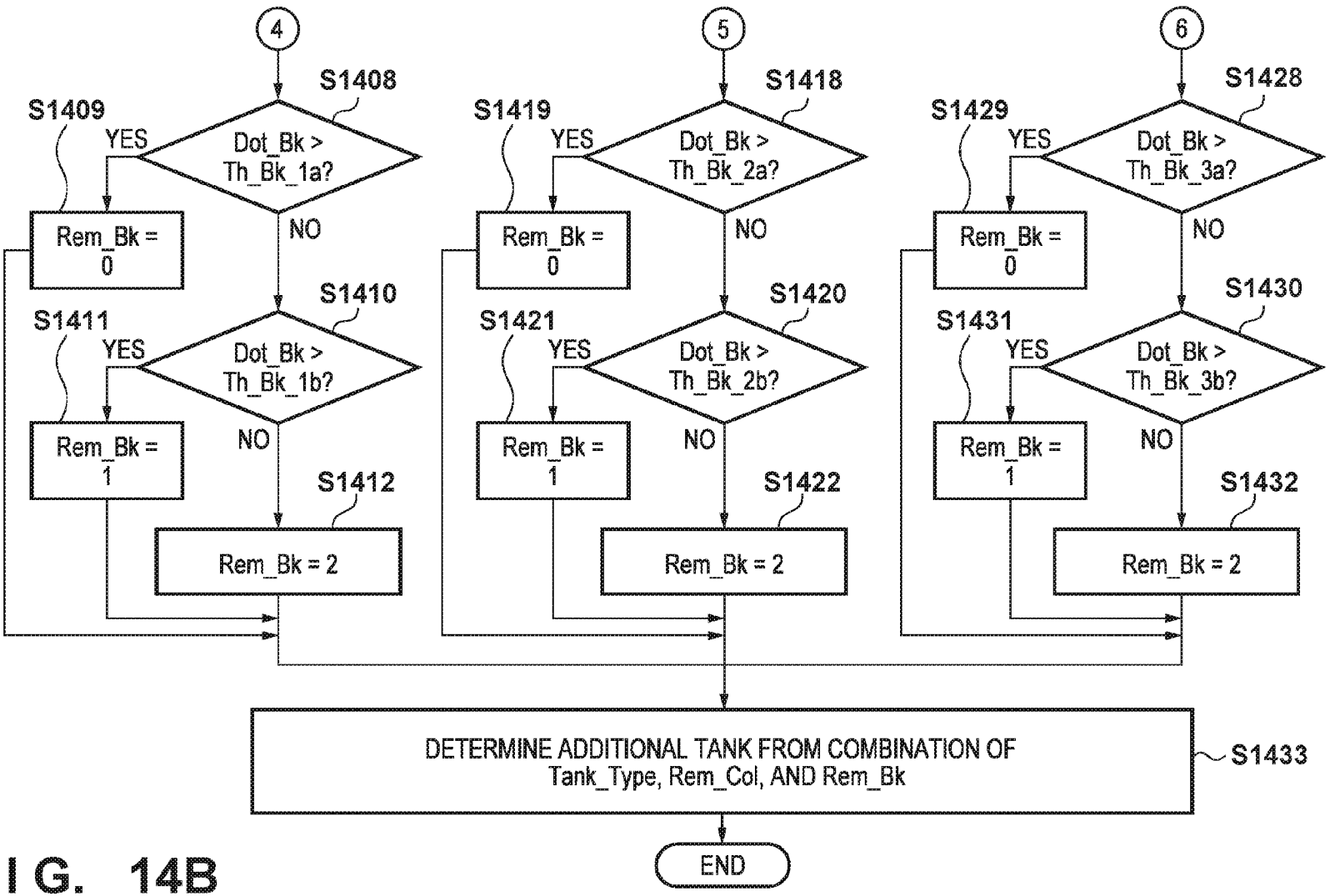

In step S1309, a CPU 211 determines whether it is necessary to prepare the next interchangeable ink tank. FIGS. 14A and 14B show processing procedures in step S1309 in detail. The processing procedures in FIGS. 14A and 14B are the same as that in FIGS. 7A and 7B except that red ink (Red) is replaced with color ink in FIGS. 7A and 7B, and hence a detailed description of each step will be omitted.

A determination method in step S1433 and a method of calculating thresholds used in steps S1403 to S1432 will be described next. First of all, each tank type is set as follows:

- a color rich tank (Col_Rich) containing an amount of color ink which is almost twice that of black ink;
- a standard tank (Std) containing almost equal amounts of red ink and black ink; and
- a black rich tank (Bk_Rich) containing an amount of black ink which is almost twice that of color ink.

Assume that the total amounts of inks in the above three types of tanks are almost equal. As described above, the amount of color inks is equivalent to the total amount of cyan ink, magenta ink, and yellow ink.

Assume that determination conditions for determining a suitable interchangeable ink tank are set as conditions 11 to 14 as follows. Assume that the consumed amount of color ink is equivalent to a value three times the consumed amount of one of cyan ink, magenta ink, and yellow ink which is consumed most.

(Condition 11) If both the remaining amount level of color ink (Rem_Col) and the remaining amount level of black ink (Rem_Bk) are 0, an ink tank identical to the currently attached ink tank is provided.

(Condition 12) If the remaining amount level of color ink (Rem_Col) is 0 and the remaining amount level of black ink (Rem_Bk) is not 0, (Condition 12-1) If the consumed amount of black ink is less than ½ that of color ink, a color rich tank (Col_Rich) is provided; and (Condition 12-2) Otherwise, a standard tank (Std) is provided.

(Condition 13) If the remaining amount level of black ink level (Rem_Bk) is 0 and the remaining amount level of color ink (Rem_Col) is not 0, (Condition 13-1) If the consumed amount of color ink is less than ½ that of black ink: a black rich tank (Bk_Rich) is provided; and (Condition 13-2) Otherwise, a standard tank (Std) is provided.

(Condition 14) If neither the remaining amount level of color ink (Rem_Col) and the remaining amount level of black ink (Rem_Bk) is 0: no ink tank replacement is required.

A reason for setting condition 11 is that if both the remaining amount levels of color ink and black ink are 0, it can be determined that the currently attached ink tank is suitable for the manner of usage by the user. A reason for conditions 12-1 and 13-1 is that if a bias in the usage of ink becomes twice or more, it can be determined that an ink tank containing frequently used ink twice in amount is suitable for the manner of usage by the user. A reason for setting conditions 12-2 and 13-2 is that if a bias in the usage of ink is less than twice, it can be determined that a standard tank is suitable for the manner of usage by the user. As described above, the consumed amount of color ink is compared with that of black ink, assuming that the consumed amount of color ink is equivalent to a value three times the consumed amount of one of cyan ink, magenta ink, and yellow ink which is consumed most.

Figure 15A:
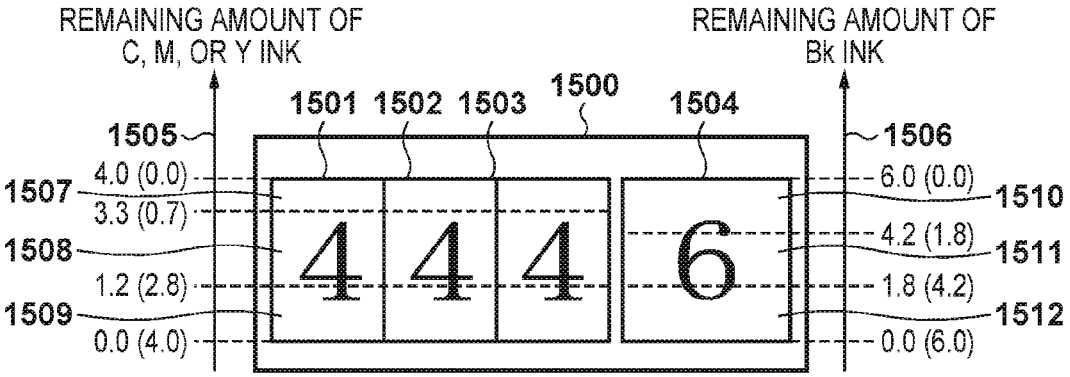
FIGS. 15A, 15B, and 15C are views for explaining thresholds used for additional tank necessity determination according to the third embodiment.
Figure 15B:
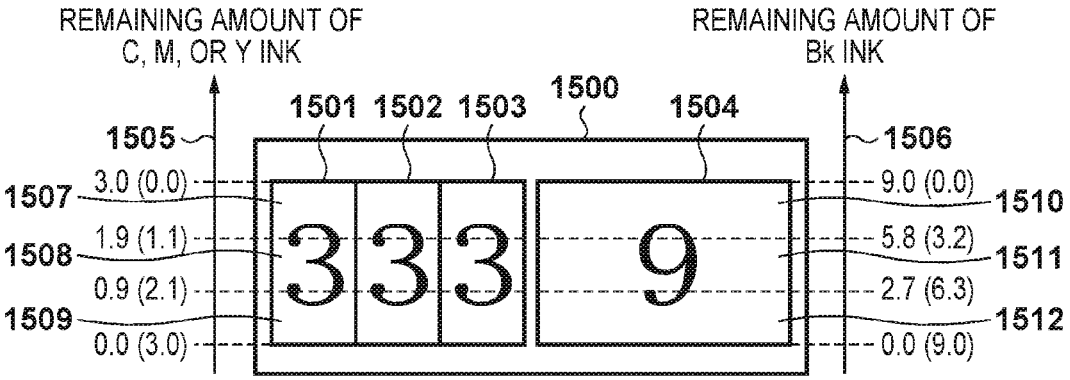
Figure 15C:
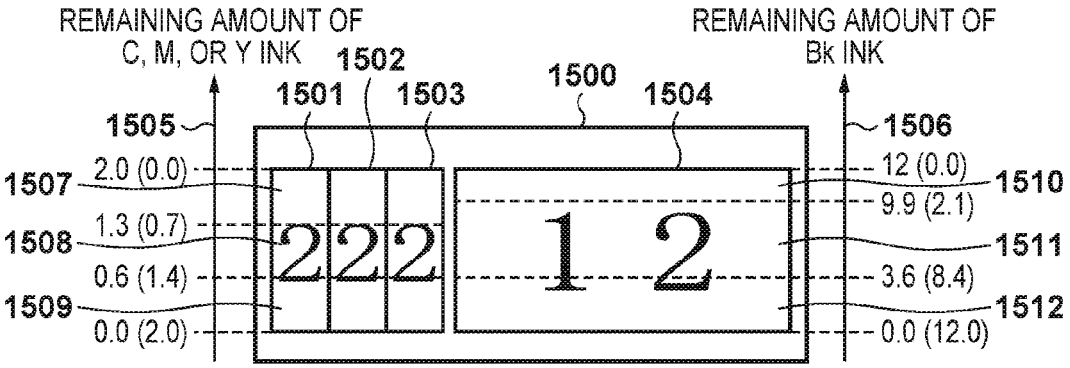

In order to implement the above determination conditions, it is necessary to determine the remaining amount levels of the respective types of inks. Assume that a threshold setting method for this is almost the same as that in the first embodiment. FIGS. 15A to 15C are views for explaining an example of the threshold setting method according to this embodiment, and respectively correspond to FIGS. 8A to 8C in the first embodiment. FIGS. 15A to 15C are views for explaining the setting of thresholds for a color rich tank (Col_Rich), a standard tank (Std), and a black rich tank (Bk_Rich).

Referring to FIGS. 15A to 15C, an ink tank 1500 includes cyan ink 1501, magenta ink 1502, yellow ink 1503, and black ink 1504. The numbers written in the illustrations of the respective types of inks 1501 to 1504 indicate the amounts of inks of the respective colors in a full state. For the sake of easy understanding, assume that the total amount of inks in each tank is 18. The number on the left of each set of parentheses on an axis 1505 indicates the remaining amount of each of cyan ink, magenta ink, and yellow ink, and the number on the left of each set of parentheses on an axis 1506 indicates the remaining amount of black ink. In addition, the numbers in the respective parentheses on the axes 1505 and 1506 indicate the usages of the respective types of inks. That is, the numerical value on the left of each set of parentheses indicates the remaining amount of the corresponding ink when used by an amount corresponding to the numerical value in the parentheses. For the sake of simplicity, assume that the amounts of cyan ink, magenta ink, and yellow ink are almost equal.

As in the first embodiment, thresholds in the procedures in FIGS. 14A and 14B are calculated as follows:

$$Th_Col_1a = Col_max_1 \times 2.8/4.0$$

$$Th_Col_1b = Col_max_1 \times 0.7/4.0$$

$$Th_Bk_1a = Bk_max_1 \times 4.2/6.0$$

$$Th_Bk_1b = Bk_max_1 \times 1.8/6.0$$

$$Th_Col_2a = Col_max_2 \times 2.1/3.0$$

$$Th_Col_2b = Col_max_2 \times 1.1/3.0$$

$$Th_Bk_2a = Bk_max_2 \times 6.3/9.0$$

$$Th_Bk_2b = Bk_max_2 \times 3.2/9.0$$

$$Th_Col_3a = Col_max_3 \times 1.4/2.0$$

$$Th_Col_3b = Col_max_3 \times 0.7/2.0$$

$$Th_Bk_3a = Bk_max_3 \times 8.4/12$$

$$Th_Bk_3b = Bk_max_3 \times 2.1/12$$

Col_max_1 is a constant representing the maximum number of dots that can be printed in color ink of one color in average when the color rich tank is full. Bk_max_1 is a constant representing the maximum number of dots that can be printed in black ink when the color rich tank is full. Likewise, Col_max_2 is a constant representing the maximum number of dots that can be printed in color ink of one color in average when the standard tank is full. Bk_max_2 is a constant representing the maximum number of dots that can be printed in black ink when the standard tank is full. In addition, Col_max_3 is a constant representing the maximum number of dots that can be printed in color ink of one color in average when the black rich tank is full. Bk_max_3 is a constant representing the maximum number of dots that can be printed in black ink when the black rich tank is full. Each constant is determined by the size of a corresponding ink tank, the discharge rate of the printhead 101, and the like.

This embodiment is based on the assumption that each type of color ink includes almost equal amounts of cyan ink, magenta ink, and yellow ink, and the discharge amounts of the respective types of inks from the head are also almost equal, as shown in FIGS. 15A to 15C. If the amounts of the respective types of color inks greatly differ from each other, a threshold may be set for each color. In addition, if the discharge amounts of the respective types of inks from the head greatly differ from each other, a threshold may be set for each color. In these cases, thresholds may be switched in accordance with the values of Dot_Col, Dot_C, Dot_M, and Dot_Y.

FIG. 16 shows the type of interchangeable ink tank required next in accordance with a combination of the remaining amount level (Rem_Col) of color ink, the remaining amount level (Rem_Bk) of black ink, and the type of ink tank (Tank_Type) currently attached to the printer. FIG. 16 corresponds to FIG. 9 in the first embodiment. As in the first embodiment, the determination method in FIG. 16 uses conditions 11 to 14 in the second embodiment. Subsequent processing is almost the same as that in the first embodiment, and hence a description of it will be omitted.

As described above, even if an integrated tank contains inks of four colors, namely cyan, magenta, yellow, and black, and ink of three colors of these types of inks are collectively handled, the same effect as that in the first embodiment can be obtained.

Fourth Embodiment

In the above embodiments, one integrated tank is attached to the printer. The fourth embodiment will exemplify a case in which a plurality of integrated tanks are attached to one printer. When replacing a plurality of integrated tanks at the same period, no problem occurs if the tanks are identical. If, however, they are different types of tanks and a wrong tank is attached to the printer, the effect of the present invention cannot be obtained. For this reason, it is necessary to perform processing different from that in the above embodiments. The following will exemplify a printer of a type to which two tanks are attached. A difference from the first embodiment will be mainly described below.

Figure 17:
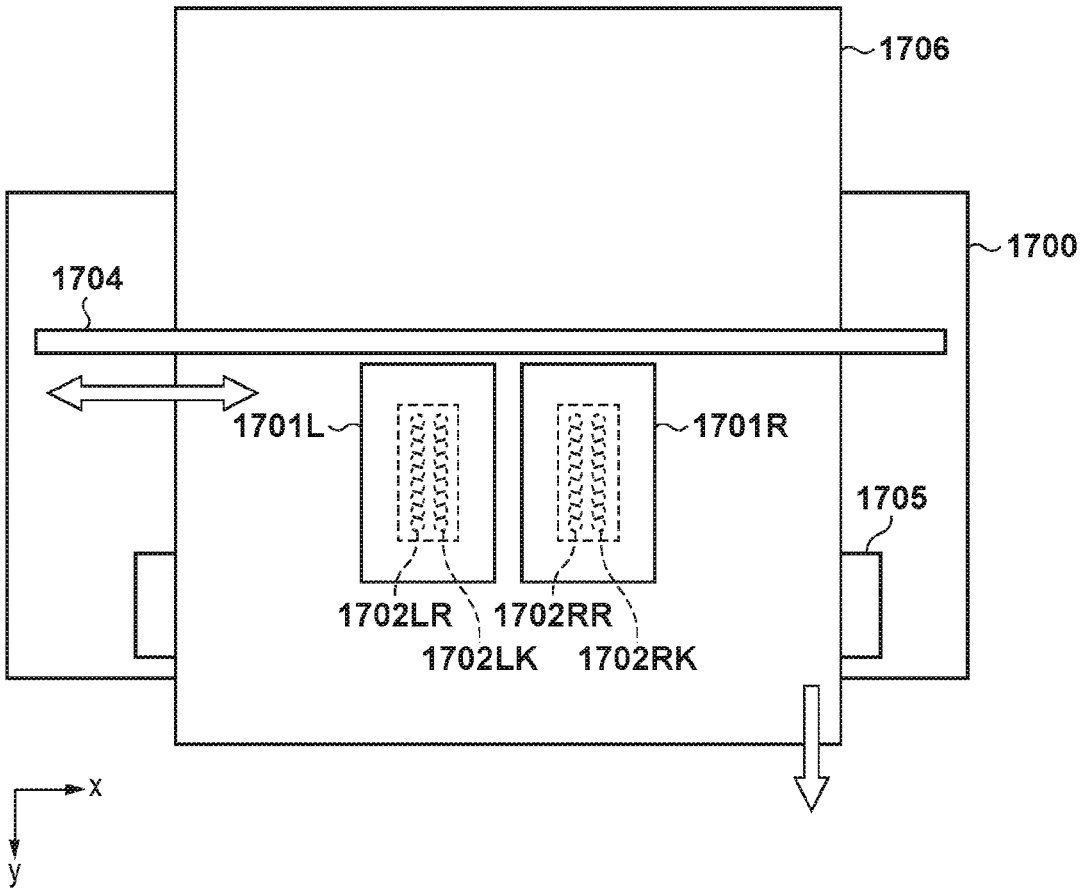
FIG. 17 is a schematic view of a printer according to the fourth embodiment.

FIG. 17 is a view schematically showing a printer according to this embodiment. This printer differs from that shown in FIG. 1 in that it includes two printheads. A printhead 1701L is equipped with a plurality of nozzles for discharging ink, and discharges red ink 1702LR and black ink 1702LK. Likewise, a printhead 1701R is equipped with a plurality of nozzles for discharging ink of the same colors as those of ink in the printhead 1701L, and discharges red ink 1702RR and black ink 1702RK. That is, the embodiment will be described on the assumption that the two integrated tanks attached to the printer contain ink of the same two colors (red and black).

Figure 18:
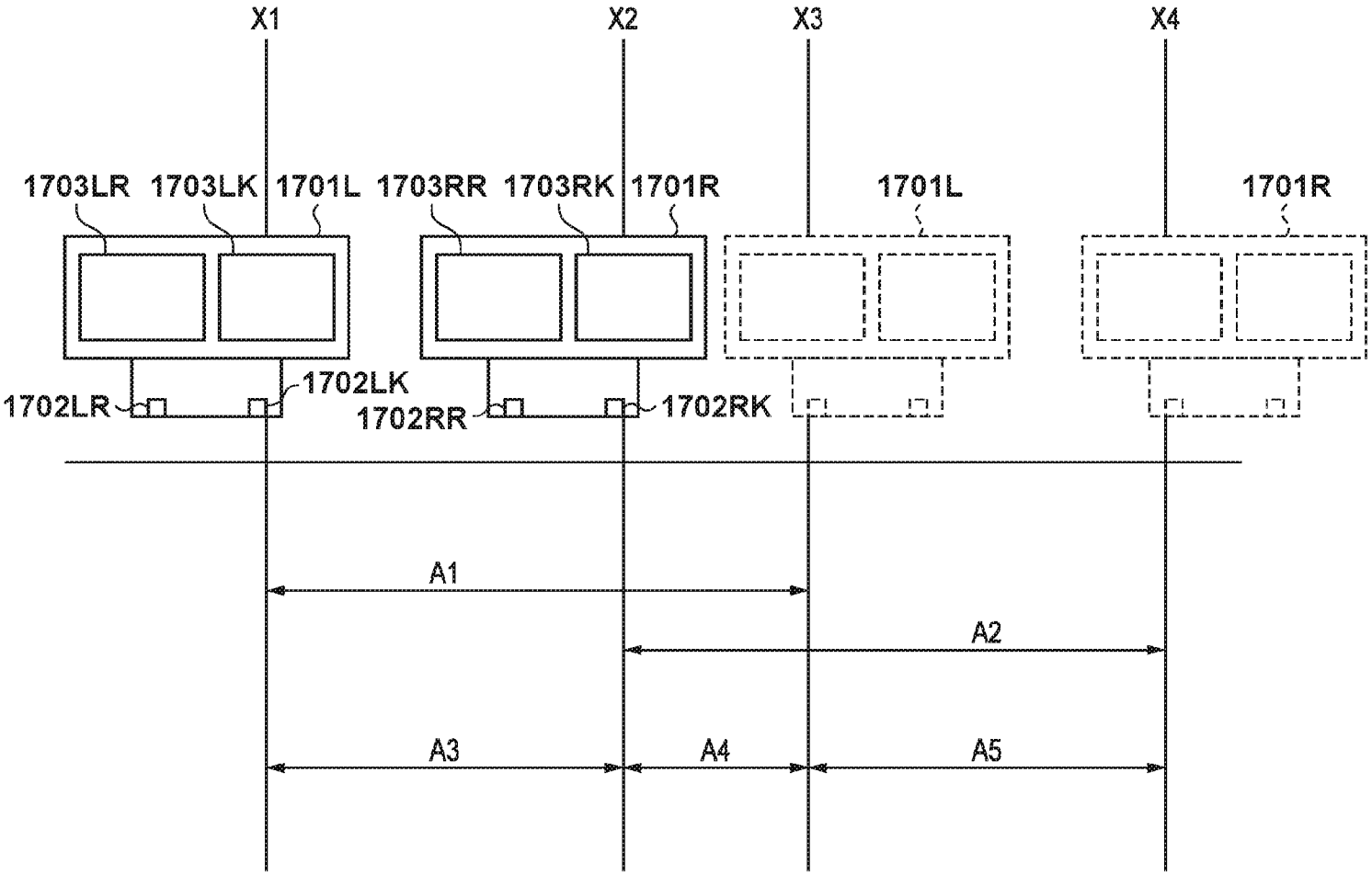
FIG. 18 is a view for explaining the operation of a printhead according to the fourth embodiment.

FIG. 18 is a view for explaining how a printer 1700 shown in FIG. 17 prints an image on a printing sheet 1706 by using the printhead 1701L and the printhead 1701R. Ink tanks 1703LR and 1703LK are respectively red and black ink tanks mounted on the printhead 1701L. The ink tanks of the respective colors are connected to nozzles of the corresponding colors, and function to supply ink to the nozzles. Likewise, ink tanks 1703RR and 1703RK are respectively red and black ink tanks mounted on the printhead 1701R.

Straight lines X1 to X4 in FIG. 18 each indicate an X-direction position on the printing sheet 1706:

X1=left end of region in which printhead 1701L can print
X2=left end of region in which printhead 1701R can print
X3=right end of region in which printhead 1701L can print
X4=right end of region in which printhead 1701R can print In addition, regions A1 to A5 in FIG. 18 indicate X-direction regions on the printing sheet 1706:

A1=region in which printhead 1701L can print
A2=region in which printhead 1701R can print
A3=region in which only printhead 1701L can print
A4=region in which both printhead 1701L and printhead 1701R can print
A5=region in which only printhead 1701R can print The printer 1700 shown FIG. 17 prints in the region A3 by using the printhead 1701L, in the region A5 by using the printhead 1701R, and in the region A4 by using both the printhead 1701L and the printhead 1701R. In this case, various methods of printing in the region A4 are conceivable, for example:

1. printing 50% each by the printhead 1701L and the printhead 1701R;
2. printing the left side relative to a predetermined X position in the region A4 by the printhead 1701L, and the right side by the printhead 1701R; and
3. printing while changing the printing ratio stepwise so as to use the printhead 1701L as the printing position becomes closer to the left side in the region A4 and use the printhead 1701R as the printing position becomes closer to the right side.

In addition, X2=X3 may be set. In this case, A1=A3 and A2=A5, and A4 does not exist.

Figure 19:
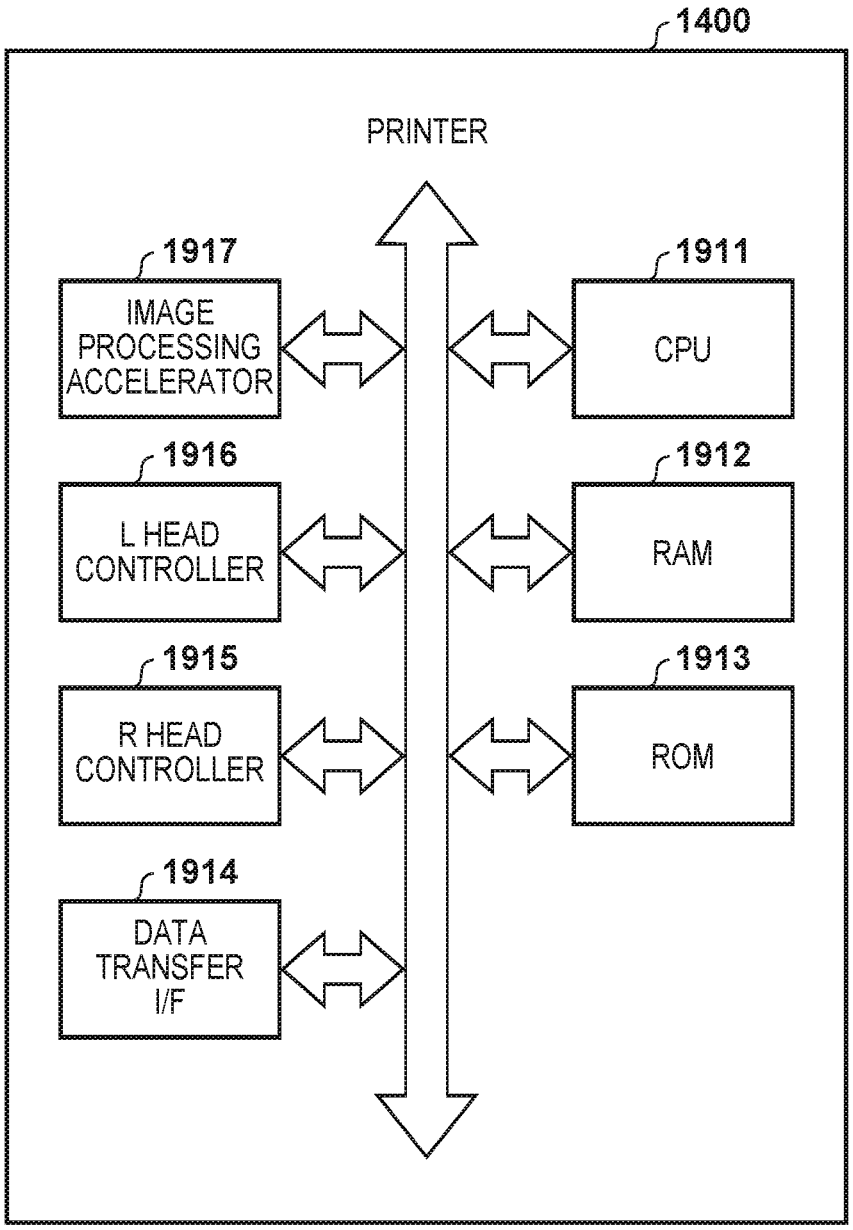
FIG. 19 is a block diagram showing an example of the hardware arrangement of the printer according to the fourth embodiment.

FIG. 19 is a block diagram showing an example of the hardware arrangement of an inkjet printer according to this embodiment. This printer differs from that shown in FIG. 2 in that it includes two head controllers. A head controller 1916L supplies print data to the printhead 1701L shown in FIG. 17 and controls the discharging operation of the printhead 1701L. More specifically, the head controller 1916L reads control parameters and print data from predetermined addresses in a RAM 1912. When a CPU 1911 writes the control parameters and the print data at predetermined addresses in the RAM 1912, the head controller 1916L activates processing to discharge ink from the printhead 1701L. Likewise, a head controller 1915R supplies print data to the printhead 1701R shown in FIG. 17, and controls the discharging operation of the printhead 1701R.

[Processing Procedure]

Figure 20A:
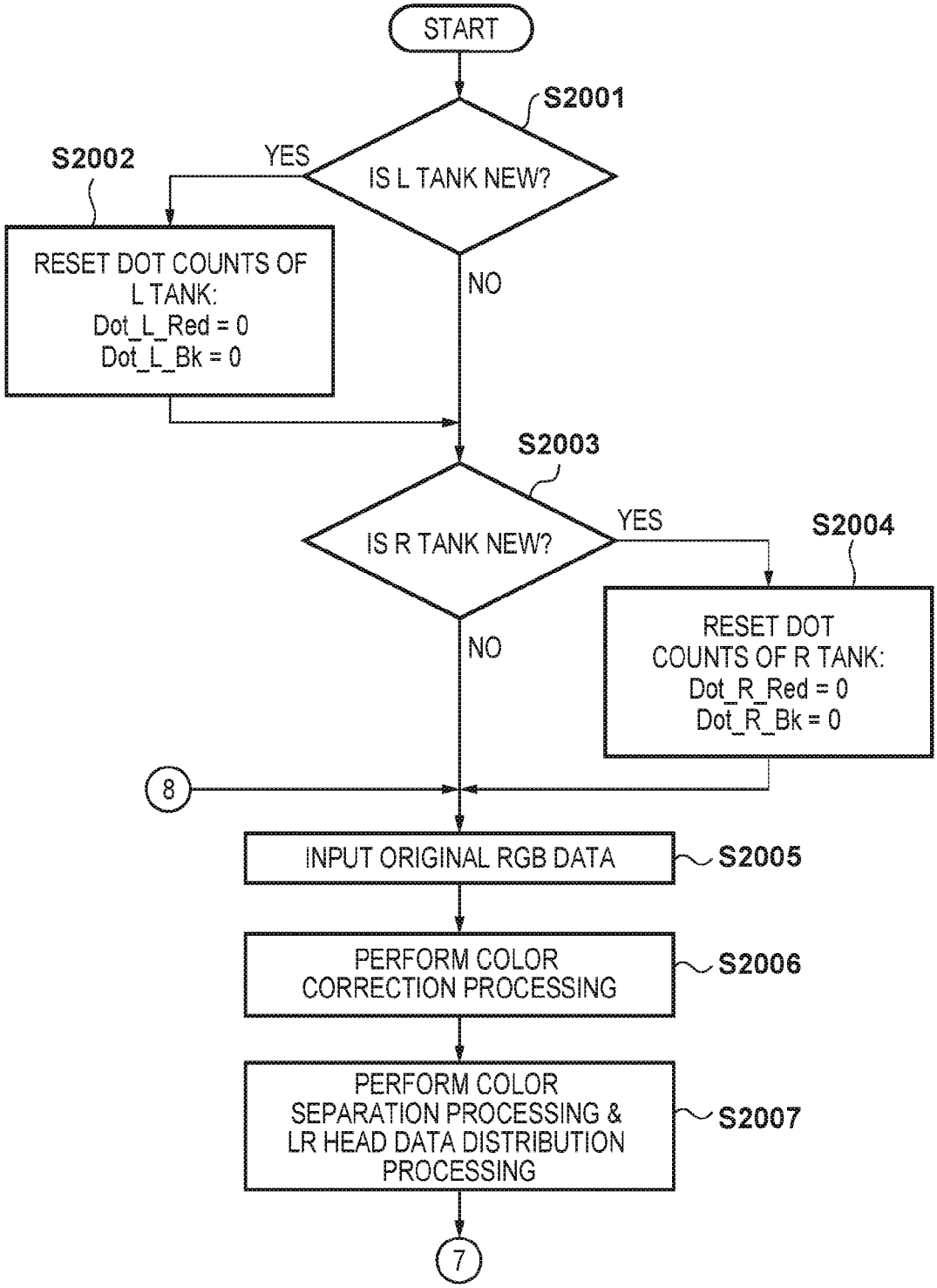
FIGS. 20A and 20B are flowcharts for printing processing according to the fourth embodiment.
Figure 20B:
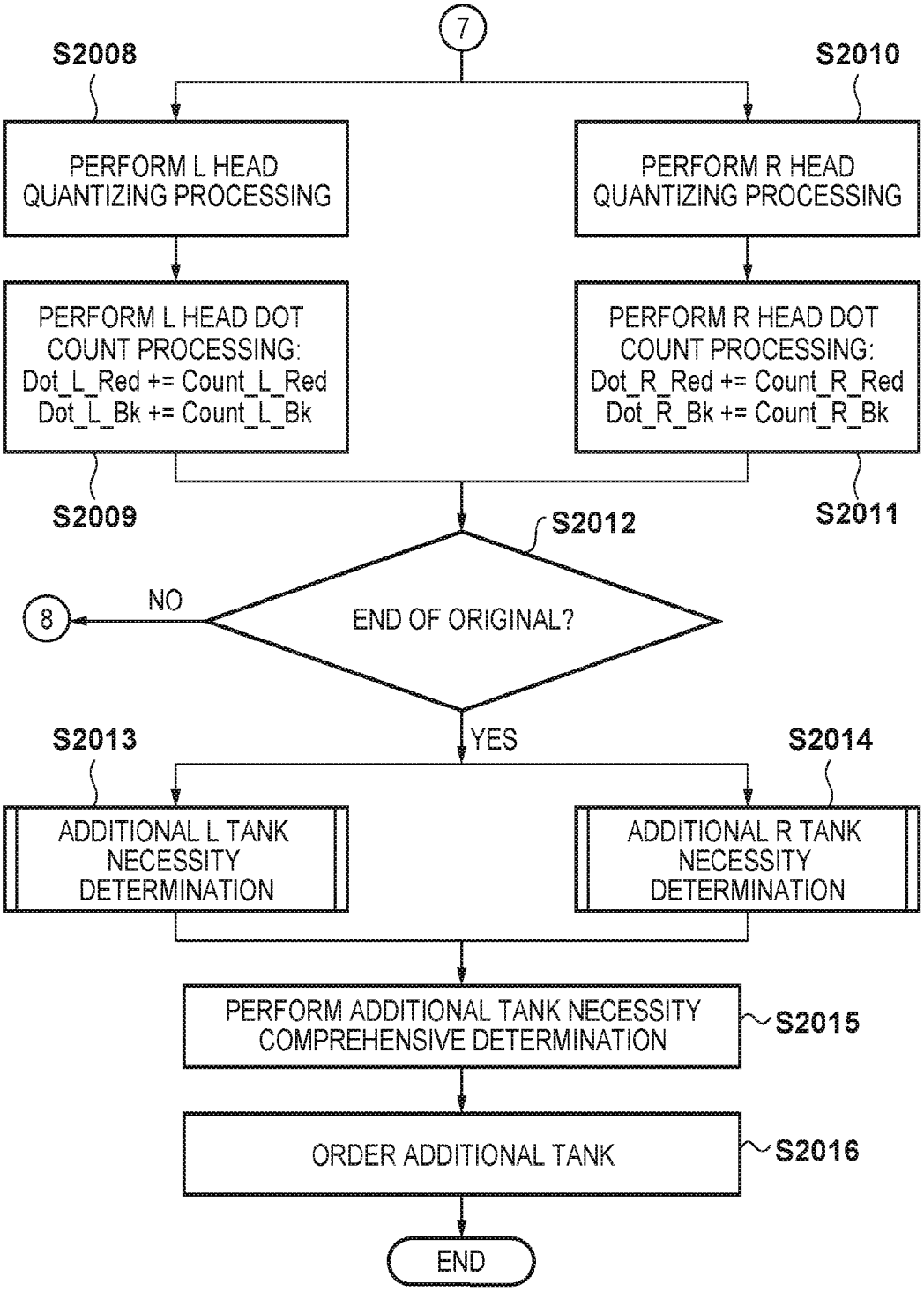

FIGS. 20A and 20B show processing procedures according to this embodiment. Assume that differences from the procedure in FIG. 6 will be mainly described, and a description of the same part as that in FIG. 6 will be omitted. The following will exemplify a case in which the system has the software arrangement shown in FIG. 5A. Therefore, a CPU 211 of the printer 100 implements this processing procedure by reading out and executing programs stored in a ROM 213.

First of all, it is necessary to determine whether the tanks are new ones and perform dot count reset processing with respect to both the left tank (L tank) and the right tank (R tank).

In step S2001, the CPU 211 determines whether the currently used L tank is a new one. If the CPU 211 determines that a new tank has just been mounted (YES in step S2001), the process advances to step S2002. If the CPU 211 determines that the tank is not a new one but has been continuously used (NO in step S2001), the process advances to step S2003. In step S2002, the CPU 211 resets the number of dots printed by the L tank. In this case, Dot_L_Red and Dot_L_Bk respectively represent the cumulative dot counts of red ink and black ink after replacement of the L tank. Thereafter, the process advances to step S2003.

In step S2003, the CPU 211 determines whether the currently used R tank is a new one. If the CPU 211 determines that a new tank has just been mounted (YES in step S2003), the process advances to step S2004. If the CPU 211 determines that the tank is not a new one but has been continuously used (NO in step S2003), the process advances to step S2005. In step S2004, the CPU 211 resets the number of dots printed by the R tank. In this case, Dot_R_Red and Dot_R_Bk respectively represent the cumulative dot counts of red ink and black ink after replacement of the R tank. Thereafter, the process advances to step S2005.

After color correction processing in step S2006, the CPU 211 performs, in step S2007, color separation processing for converting RGB values into the usages of red ink and black ink, and allocates the usages of the respective types of inks to the printhead 1701L and the printhead 1701R. Let Rout and Kout, respectively, be the ink amount values of red ink and black ink after the color separation processing, LRout and LKout, respectively, be the ink amount values of red ink and black ink of the printhead L, and RRout and RKout, respectively, be the ink amount values of red ink and black ink of the printhead R. Ink amount values may be distributed to the regions A3, A4, and A5 in FIG. 18 in the following manner:

Region A3:

$$LRout=Rout$$

$$LKout=Kout$$

Region A5:

$$RRout=Rout$$

$$RKout=Kout$$

Region A4:

$$LRout=Rout\times 1/2$$

$$LKout=Kout\times 1/2$$

$$RRout=Rout\times 1/2$$

$$RKout=Kout\times 1/2$$

In step S2008, the CPU 211 performs quantizing processing for converting the ink usages LRout and LKout on the printhead 1701L side into information representing the presence/absence of each dot to be actually printed. Likewise, in step S2010, the CPU 211 performs quantizing processing for converting the ink usages RRout and RKout on the printhead 1701R side into information representing the presence/absence of each dot to be actually printed. This quantizing processing may be performed by using any technique such as known error diffusion processing or dither processing. When the quantized dot data is sent to each printhead and the preparation of dot data corresponding to one scan is complete, actual printing is performed on the printing sheet 106 by using the printhead 1701L and the printhead 1701R.

In step S2009, the CPU 211 performs the accumulation processing of counting the numbers of dots from the dot data quantized for the printhead 1701L.

$$Dot_L_Red+=Count_L_Red$$

$$Dot_L_Bk+=Count_L_Bk$$

where Count_L_Red and Count_L_Bk respectively represent print dot counts of red ink and black ink on the printhead 1701L side. Likewise, in step S2011, the CPU 211 performs the accumulation processing of counting the numbers of dots from the dot data quantized for the printhead 1701R.

$$Dot_R_Red+=Count_R_Red$$

$$Dot_R_Bk+=Count_R_Bk$$

where Count_R_Red and Count_R_Bk respectively represent print dot counts of red ink and black ink on the printhead 1701R side.

In step S2013, the CPU 211 determines whether it is necessary to prepare an interchangeable ink tank for the printhead 1701L. In addition, in step S2014, the CPU 211 determines whether it is necessary to prepare an interchangeable ink tank for the printhead 1701R. Since the same determination method as that in the first embodiment may be applied to the printhead 1701L and the printhead 1701R, a detailed description of the method will be omitted.

In step S2015, the CPU 211 comprehensively determines, based on the determination results obtained in steps S2013 and S2014, which interchangeable ink tank or tanks should be used. FIG. 21 shows a table used in the determination processing in step S2015. The CPU 211 determines an interchangeable ink tank or tanks in accordance with a combination of the determination result for the printhead 1701L obtained in step S2013 and the determination result for the printhead 1701R obtained in step S2014. Assume that determination conditions are conditions 15 and 16 as follows:

(Condition 15) If the determination results in steps S2013 and S2014 are the same, the determination results in steps S2013 and S2014 are used without any change.

(Condition 16) If the determination results in steps S2013 and S2014 are different, (Condition 16-1) If one of the determination results indicates that no interchangeable ink tank is required: the determination results in steps S2013 and S2014 are used without any change; and (Condition 16-2) Otherwise, a standard tank (Std) is provided.

A reason for setting conditions 15 and 16-1 is that since there is no possibility of erroneously attaching an ink tank, it can be determined that it is suitable to use the respective determination results without any change. The following is a reason for setting condition 16-2. First of all, when using two different types of ink tanks, since there is a possibility of wasting more ink upon attachment of a wrong ink tank, it is necessary to prepare two ink tanks of the same type. Preparing two ink tanks of the same type as standard tanks (Std) makes it possible to equalize the amount of ink wasted at the time of ink tank replacement to that when only one type of standard tank is used as an integrated tank. This embodiment can reduce the amount of ink wasted at the time of ink tank replacement when condition 15 and condition 16-1 are satisfied.

Subsequent processing is almost the same as that in the first embodiment, and hence a description of it will be omitted.

As described above, even if two integrated tanks are attached to the printer, the same effect as that in the first embodiment can be obtained. Note that the number of integrated tanks attached to the printer is not limited to two, and this embodiment can also be applied to a printer capable of being equipped with more integrated tanks.

Fifth Embodiment

The fourth embodiment has exemplified the case in which a plurality of integrated tanks are attached to one printer. The fifth embodiment will exemplify a case in which the user uses a plurality of printers, and the ink tanks in the respective printers are replacement targets. For the sake of simplicity, the following will describe a method of determining an interchangeable ink tank in accordance with a combination of additional tank necessity determination results concerning two printers. Differences from the above embodiments will be mainly described below, and any redundant description will be omitted.

Figures 22A, 22B, 22C:
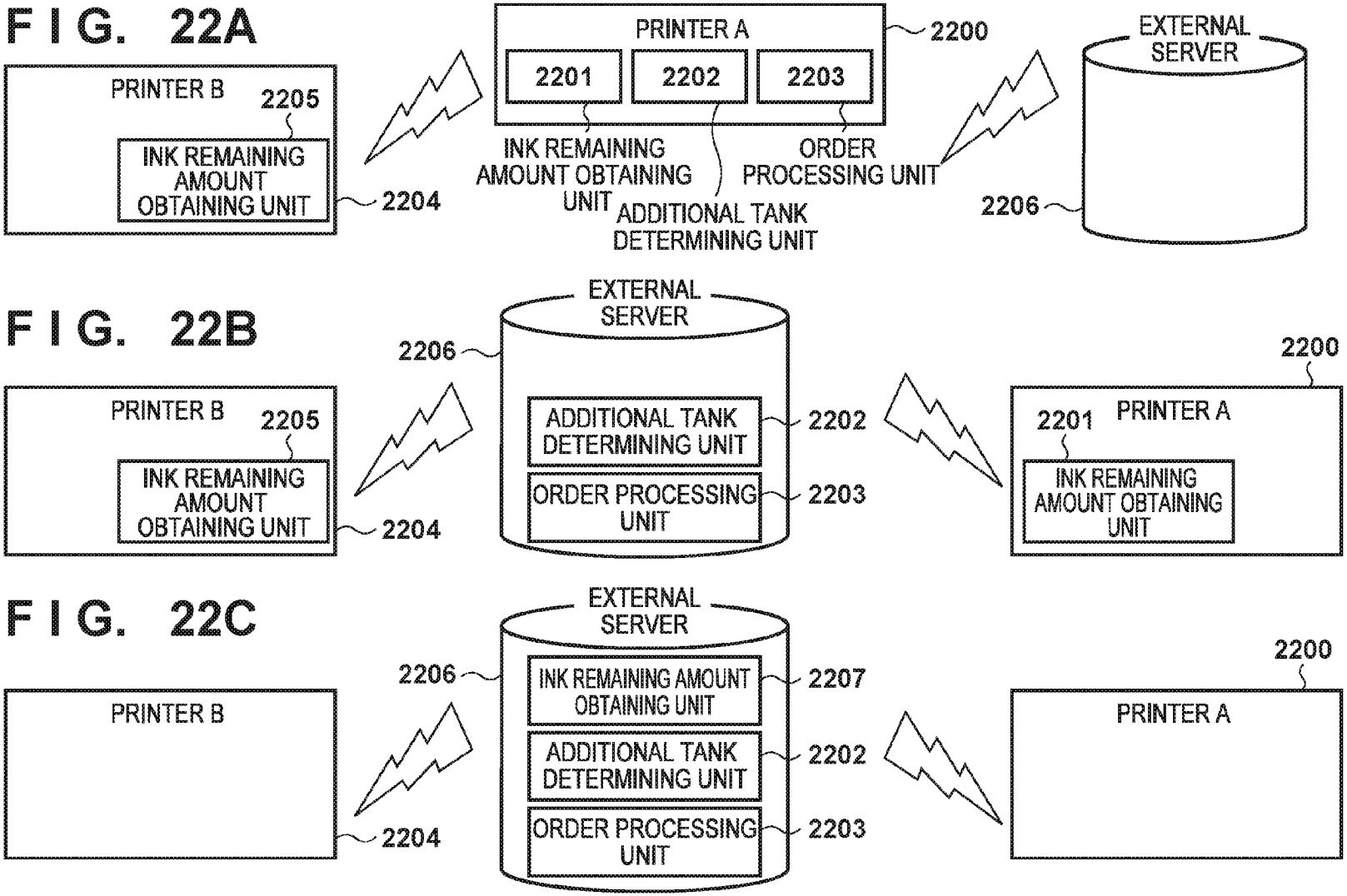
FIGS. 22A, 22B, and 22C are block diagrams showing an example of the software arrangement of a system according to the fifth embodiment.

FIGS. 22A to 22C are block diagrams each showing an example of the software arrangement of a system according to this embodiment. FIGS. 22A to 22C correspond to FIGS. 5A to 5C in the first embodiment. In this embodiment, the system includes one external server and two printers. Note that the number of printers is an example and not exhaustive.

Referring to FIG. 22A, a printer A 2200 includes an ink remaining amount obtaining unit 2201, an additional tank determining unit 2202, and an order processing unit 2203. A printer B 2204 includes an ink remaining amount obtaining unit 2205. The ink remaining amount obtaining unit 2201 obtains information concerning the remaining amount of ink or the consumed amount of ink of the printer A 2200. The ink remaining amount obtaining unit 2205 obtains information concerning the remaining amount of ink or the consumed amount of ink of the printer B 2204. The additional tank determining unit 2202 determines the next interchangeable ink tank for the printer A 2200 based on the information obtained by the ink remaining amount obtaining unit 2201. In addition, referring to FIG. 22A, the printer A 2200 is connected to the printer B 2204 via a network, and information concerning the remaining amount of ink or the consumed amount of ink of the printer B 2204 is sent to the printer A 2200. Therefore, the ink remaining amount obtaining unit 2201 of the printer A 2200 may obtain information concerning ink of the printer B 2204 sent from the printer B 2204.

The additional tank determining unit 2202 determines the next interchangeable ink tank for the printer B 2204 based on the information obtained by the ink remaining amount obtaining unit 2205. The order processing unit 2203 accesses an external server 2206 via a communication network such as the Internet, and sends order information of an interchangeable ink tank for the printer A 2200 and the printer B 2204 to the external server 2206. When sending order information to the external server 2206, order information of the printer A 2200 and order information of the printer B 2204 may be collectively or separately sent. In addition, referring to FIG. 22A, only the printer A 2200 has the additional tank determining unit 2202 and the order processing unit 2203. However, each printer may have the additional tank determining unit 2202 and the order processing unit 2203.

As shown in FIG. 22B, instead of the printer A 2200, the external server 2206 may have the additional tank determining unit 2202 and the order processing unit 2203. In this case, the printer A 2200 sends information concerning the remaining amount of ink or the consumed amount of ink obtained by the ink remaining amount obtaining unit 2201 to the external server 2206. In addition, the printer B 2204 sends information concerning the remaining amount of ink or the consumed amount of ink obtained by the ink remaining amount obtaining unit 2205 to the external server 2206. The external server 2206 determines the next interchangeable ink tank for each printer by using the additional tank determining unit 2202 based on the information concerning the remaining amount of ink or the consumed amount of ink obtained from each printer. Furthermore, the external server 2206 performs order processing for the determined interchangeable ink tanks by using the order processing unit 2203.

As shown in FIG. 22C, the external server 2206 may have an ink remaining amount obtaining unit 2207, the additional tank determining unit 2202, and the order processing unit 2203. In this case, the ink remaining amount obtaining unit 2207 obtains information concerning the remaining amounts of inks or the consumed amounts of inks of both the printer A 2200 and the printer B 2204. In this arrangement, each printer sends information concerning ink to the external server 2206 in accordance with a request from the external server 2206 or periodically.

This embodiment will be described on the assumption that integrated tanks attached to a plurality of printers each contain the same inks of two colors (red and black).

[Processing Procedure]

FIG. 23 shows a processing procedure according to this embodiment. Assume that differences from the procedure in FIG. 6 will be mainly described, and a description of the same part as that in FIG. 6 will be omitted. The differences from the procedure in FIG. 6 correspond to steps S2309 to S2311.

In step S2309, each printer sends its ink remaining amount information to a subject which performs additional tank necessity determination (that is, an apparatus including the additional tank determining unit 2202). When, for example, the additional tank determining unit 2202 is provided for the external server 2206, each printer sends information concerning ink to the external server 2206.

In step S2310, the additional tank determining unit 2202 determines whether it is necessary to prepare an interchangeable ink tank for the printer A 2200. In addition, in step S2311, the additional tank determining unit 2202 determines whether it is necessary to prepare an interchangeable ink tank for the printer B 2204. Since the same determination method as that in the first embodiment can be applied to the printer A 2200 and the printer B 2204, a detailed description of the method will be omitted.

In step S2312, the additional tank determining unit 2202 comprehensively determines, based on the determination results obtained in steps S2310 and S2311, which interchangeable ink tank or tanks should be used. Determination conditions and a determination method to be used are the same as those in the fourth embodiment, and hence a detailed description of them will be omitted. More specifically, a determination result for the printhead 1701L in FIG. 21 may be rewritten for the printer A 2200, and a determination result for the printhead 1701R may be rewritten for the printer B 2204. The above processing is the same as that in other embodiments, and hence a description of it will be omitted.

The relationship between FIGS. 22A to 22C and FIG. 23 will be described. In the arrangement shown in FIG. 22A, the printer B 2204 executes steps S2301 to S2309 in the processing procedure shown in FIG. 23, and sends the determination result to the printer A 2200. The printer A 2200 executes the processing procedure shown in FIG. 23, and sends the execution result to the external server 2206. In the arrangement shown in FIG. 22B, the printer A 2200 and the printer B 2204 each execute steps S2301 to S2309 in the procedure shown in FIG. 23. The external server 2206 executes steps S2310 to S2313. In the arrangement shown in FIG. 22C, the external server 2206 executes steps S2301 to S2313 in the procedure shown in FIG. 23. Assume that in processing in step S2309, the external server 2206 receives information from each printer in advance.

As described above, even when the user uses a plurality of printers and ink tanks in the respective printers are replacement targets, it is possible to obtain the same effect as that in the first embodiment. The number of printers is not limited to two, and this system may include more printers. In addition, when the system includes a plurality of printers, interchangeable ink tanks may be determined based on information concerning a plurality of printers, extracted from the printers included in the system, in which currently attached ink tanks include inks of the same color.

In the present invention, ink has been exemplified as a printing material, but a printing material need not be limited to ink.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-076117, filed Apr. 5, 2016, which is hereby incorporated by reference herein in its entirety.

What is claimed is:

1. A system which provides an interchangeable tank for a printing apparatus to which at least one tank containing printing materials of at least two colors is attached, comprising:

an obtaining unit configured to obtain predetermined information relating to amount of printing materials for a tank attached to the printing apparatus; and a determining unit configured to determine an interchangeable tank to be provided from a plurality of types of interchangeable tanks based on the predetermined information obtained by the obtaining unit, wherein the plurality of types of interchangeable tanks include a first tank and a second tank, the first tank contains printing materials of at least two colors, with a ratio of amounts of the printing materials of the at least two colors being a first constituent ratio, and the second tank contains printing materials of at least the same two colors as those in the first tank, with a ratio of amounts of the printing materials of at least the two colors being a second constituent ratio different from the first constituent ratio.

2. The system according to claim 1, wherein the determining unit determines the interchangeable tank based on the predetermined information obtained by the obtaining unit in accordance with a manner of usage of each of at least two printing materials in the at least one tank attached to the printing apparatus.

3. The system according to claim 1, wherein the determining unit determines an interchangeable tank to be provided based on the predetermined information obtained by the obtaining unit and a history of interchangeable tanks determined by the determining unit.

4. The system according to claim 1, wherein the determining unit determines an interchangeable tank to be provided based on the predetermined information obtained by the obtaining unit and a history of tanks attached to the printing apparatus.

5. The system according to claim 1, wherein the first tank and the second tank each contain printing materials of at least two colors of red, black, cyan, magenta, and yellow printing materials.

6. The system according to claim 1, wherein the first and second constituent ratios are set by changing a position of an interior wall for separating at least two printing materials contained in a tank.

7. The system according to claim 1, wherein the first and second constituent ratios are set by changing injection amounts of at least two printing materials contained in a tank.

8. The system according to claim 1, wherein the predetermined information is a cumulative value of dots of a printing material discharged by a printhead of the printing apparatus.

9. The system according to claim 1, further comprising a detecting unit configured to detect a remaining amount of each of at least two printing materials contained in a tank attached to the printing apparatus, wherein the predetermined information is a remaining amount of printing material detected by the detecting unit.

10. The system according to claim 1, wherein the predetermined information is consumption information of printing materials of the tank or remaining information of printing materials in the tank.

11. The system according to claim 1, wherein the first tank and the second tank each contain printing materials of at least three colors, and the interchangeable tank is determined based on the predetermined information obtained by the obtaining unit in accordance with a manner of usage of a first printing material of the printing materials of the at least three colors and a collective manner of usage of other printing materials.

12. The system according to claim 10, wherein the first printing material comprises a black printing material, and the other printing materials comprise printing materials of colors other than black.

13. The system according to claim 1, wherein at least two tanks each containing printing materials of at least two colors are attached to the printing apparatus, and the determining unit determines an interchangeable tank for each of the at least two tanks based on the predetermined information of the at least two tanks.

14. The system according to claim 1, further comprising a plurality of printing apparatuses each including at least one tank containing printing materials of at least two colors, the obtaining unit obtains the predetermined information of a tank attached to each of the plurality of printing apparatuses, and the determining unit determines an interchangeable tank for each of the plurality of printing apparatuses based on the predetermined information of a tank attached to each of the plurality of printing apparatuses.

15. The system according to claim 1, further comprising an ordering unit configured to perform order processing with respect to an interchangeable tank determined by the determining unit.

16. A printing apparatus equipped with at least one tank containing printing materials of at least two colors, comprising:

an obtaining unit configured to obtain predetermined information relating to amount of printing materials for a tank attached to the printing apparatus; and a determining unit configured to determine an interchangeable tank to be provided from a plurality of types of interchangeable tanks based on the predetermined information obtained by the obtaining unit, wherein the plurality of types of interchangeable tanks include a first tank and a second tank, the first tank contains printing materials of at least two colors, with a ratio of amounts of the printing materials of the at least two colors being a first constituent ratio, and the second tank contains printing materials of at least the same two colors as those in the first tank, with a ratio of amounts of the printing materials of at least the two colors being a second constituent ratio different from the first constituent ratio.

17. The apparatus according to claim 16, further comprising an ordering unit configured to perform ordering processing with respect to an interchangeable tank determined by the determining unit.

18. A method of controlling a system which provides an interchangeable tank for a printing apparatus to which at least one tank containing printing materials of at least two colors is attached, comprising:

obtaining predetermined information relating to amount of printing materials for a tank attached to the printing apparatus; and determining an interchangeable tank to be provided from a plurality of types of interchangeable tanks based on the predetermined information obtained in the obtaining, wherein the plurality of types of interchangeable tanks include a first tank and a second tank, the first tank contains printing materials of at least two colors, with a ratio of amounts of the printing materials of the at least two colors being a first constituent ratio, and the second tank contains printing materials of at least the same two colors as those in the first tank, with a ratio of amounts of the printing materials of at least the two colors being a second constituent ratio different from the first constituent ratio.

* * * * *